US006748182B2

(12) United States Patent
Yoshida et al.

(10) Patent No.: US 6,748,182 B2
(45) Date of Patent: Jun. 8, 2004

(54) REPLACING PART CONTAINING CONSUMABLE PART AND IMAGE FORMING APPARATUS USING REPLACING PART

(75) Inventors: Takashi Yoshida, Minori (JP); Taichiro Yamashita, Tsuchiura (JP); Junichi Tamamoto, Chiyoda (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/960,281

(22) Filed: Sep. 24, 2001

(65) Prior Publication Data

US 2002/0085847 A1 Jul. 4, 2002

(30) Foreign Application Priority Data

Sep. 26, 2000 (JP) ..... 2000-297053

(51) Int. Cl.[7] ..... G03G 15/00
(52) U.S. Cl. ..... 399/12; 399/27
(58) Field of Search ..... 399/12, 27, 8, 399/262, 258, 24, 30; 347/86; 340/612, 617

(56) References Cited

U.S. PATENT DOCUMENTS 4,961,088 A * 10/1990 Gilliland et al. ..... 399/25
5,132,729 A * 7/1992 Matsushita et al. ..... 399/24
5,579,088 A * 11/1996 Ko ..... 399/12
5,930,553 A * 7/1999 Hirst et al. ..... 399/8
5,956,541 A * 9/1999 Hoshika et al. ..... 399/24
6,226,025 B1 * 5/2001 Kim ..... 347/228
6,233,410 B1 * 5/2001 Seber et al. ..... 399/24
6,266,492 B1 * 7/2001 Maehara ..... 399/12
6,363,226 B1 * 3/2002 Batori ..... 399/8
6,385,407 B1 * 5/2002 Inose ..... 399/24
6,408,141 B1 * 6/2002 Tahara ..... 399/12

OTHER PUBLICATIONS

U.S. patent No. 6158837.
U.S. patent No. 5283613.
JP–A–6–149051 (only abstract).
JP–A–10–69139 (only abstract).
JP–A–10–133528 (only abstract).

* cited by examiner

*Primary Examiner*—Robert Beatty
(74) *Attorney, Agent, or Firm*—Antonelli, Terry, Stout & Kraus, LLP

(57) ABSTRACT

A low cost and high accuracy replacing part identification system capable of detecting and excluding the dishonest use of an image forming apparatus containing a consumable. A memory storage device having a particular ID number stored therein is attached to a toner cartridge. If the toner cartridge is used, hysteresis data (data that cannot be re-written to its original value) is stored in the memory storage device and the ID number is stored in an ID storing unit to prevent the cartridge from being able to be used by other apparatuses. Since a control unit detects the number of time of use and a toner level detecting unit detects the data of a toner level in the toner cartridge to store as the hysteresis data in the memory storage device, a toner cartridge which imitation toner was refilled can be detected and prevented from being used.

17 Claims, 11 Drawing Sheets

REPLACING PART CONTAINING CONSUMABLE PART AND IMAGE FORMING APPARATUS USING REPLACING PART

BACKGROUND OF THE INVENTION

The present invention relates in general to a replacing part identifying system for detecting whether or not any of replacing parts which have been reclaimed by the recycling is properly used. More particularly, the invention relates to a replacing part identifying system for identifying whether or not a cartridge self-containing an image forming material for printers or copying machines is genuine, and an image forming apparatus (device) having the same applied thereto.

In the case where imitations other than genuine parts are used in consumables and replacing parts each self-containing a consumable, there arises the problem that not only the proper performance can not be obtained, but also the serious accident such as the failure of an apparatus is caused. As for the prior art of such a replacing part identifying system, there are disclosed ones described in JP-A-6-149051, JP-A-10-69139 and JP-A-10-133528.

Then, each of these replacing part identification systems employs an identification apparatus which is designed in such a way that a data carrier employing a semiconductor memory is mounted to a toner cartridge or an ink cartridge self-containing a consumable material such as toner or ink used in copying machines or printers in order to carry out the comparison with respect to the identification data to judge whether or not the toner cartridge or the ink cartridge is the genuine part. In these identification apparatuses, an identification code, the data of the number of times of use, the data of the number of times of reclamation, and an consumed amount of consumable material are recorded in a semiconductor memory to detect whether or not the match is obtained for the identification codes, detect whether or not the number of times of recording, the number of sheets of used recording papers, or the number of times of reclamation is respectively equal to or larger than an setting value, and detect whether or not an amount of consumable material is increased, thereby identifying whether the toner cartridge or the ink cartridge is an imitation or a genuine part.

SUMMARY OF THE INVENTION

However, in the identification based on the identification code stored in the semiconductor memory in these prior arts, there arises the problem that when the recycled part is supplied in which the imitation consumable material was refilled, since the cartridge to which the data carrier is attached is the genuine part, it is impossible to judge whether or not the cartridge is the imitation. In addition, though the semiconductor memory is broken down in order to make the reclamation thereof impossible, since the destructive order is carried out in accordance with the instruction issued from a user, there arises the problem that breakdown miss may occur so that the recycled part may be resupplied in which the imitation consumable material was refilled.

In addition, since the semiconductor memory is used in which the data of the number of times of use, the data of the number of times of reclamation and the data of the consumable material level are stored, but which is rewritable, and also since the commercial semiconductor memory can be used, there arises the problem that it is possible to alter dishonestly the data and hence it is impossible to detect the dishonest use. In addition, conventionally, since the semiconductor memory which is of a type in which the data can be written to the data carrier is used, there arises the problem that the cost thereof is high and hence the system can not be made fit for practical use.

In the light of the foregoing, the present invention has been made in order to solve the above-mentioned problems associated with the prior art, and it is therefore an object of the present invention to provide a low cost and high accuracy replacing part identifying system which is capable of detecting the dishonest use of any of imitation replacing parts such as recycling goods to exclude them. In addition, it is another object of the present invention to provide an image forming apparatus having the above-mentioned system applied thereto.

In order to solve the above-mentioned problems, according to the present invention, there is provided a replacing part identifying system wherein a replacing part is provided with: an identification data storing unit for, outputting peculiar identification data in accordance with a reading-out request made from the outside; and a hysteresis holding unit for after having responded to the reading-out request, holding the initial read-out hysteresis in which the identification data was read out, and wherein in an apparatus using the replacing part, the peculiar identification data is stored in the apparatus which was firstly used; when the peculiar identification data, of the replacing part, which has been read out matches the identification data stored in the apparatus and also the read-out hysteresis is present in the hysteresis holding unit, the replacing part is permitted to be used; and when the peculiar identification data, of the replacing part, which has been read out does not match the identification data stored in the apparatus and also the read-out hysteresis is present in the hysteresis holding unit, the replacing part is not permitted to be used.

In addition, the hysteresis holding unit permits the writing operation only once using an additional storage memory in order to prevent the data from being dishonestly altered.

In addition, the hysteresis holding unit is another unit for storing therein the identification data, and the identification data peculiar to the another identification data storing unit of interest is used to enhance the security.

In addition, the hysteresis holding unit is designed in such a way that after the initial reading-out request has been made to the identification data storing unit from the outside, the identification data in the another unit for storing the identification data can not be read out.

In addition, the data of the consumable level is stored in the hysteresis holding unit, and this consumable level is compared with the consumable level of the replacing part. Then, when it is judged that the consumable level of the replacing part is increased, the replacing part is not permitted to be used.

Also, the data of the number of sheets of image recording papers is stored in the hysteresis holding unit. Then, when it is judged that the number of sheets of image recording papers has become equal to or larger than a setting value, the replacing part is not permitted to be used.

Also, the data of the consumable level and the data of the number of sheets of image recording papers are both stored in the hysteresis holding unit. Then, on and after a time point when the consumable level has become equal to or smaller than the setting value, the number of sheets of image recording papers is counted and also the data thereof is stored. When the number of sheets of image recording papers has become equal to or larger than the setting value, the replacing part is not permitted to be used.

Also, the image forming apparatus is provided with an identification data inputting unit for adding the identification data from the outside of the image forming apparatus to the above-mentioned identification data storing unit through a network, so that the comparison and the management of the ID numbers of all of the consumables can be carried out.

Also, the image forming apparatus is provided with an identification data inputting unit for adding the identification data from the outside of the image forming apparatus to the above-mentioned identification data storing unit through a portable storage medium, so that the comparison and the management of the ID numbers of all of the consumables can be carried out.

Moreover, a recording apparatus and an ID managing center are coupled to each other through a network so that the ID numbers and the hysteresis data of the replacing parts are collectively managed in the ID managing center, whereby the service and the security are enhanced.

BRIEF DESCRIPTION OF THE DRAWINGS

The above and other objects as well as advantages of the present invention will become clear by the following description of the embodiments of the present invention with reference to the accompanying drawings, wherein.

DESCRIPTION OF THE EMBODIMENTS

The embodiments of the present invention will hereinafter be described in detail with reference to the accompanying drawings.

Figure 1:
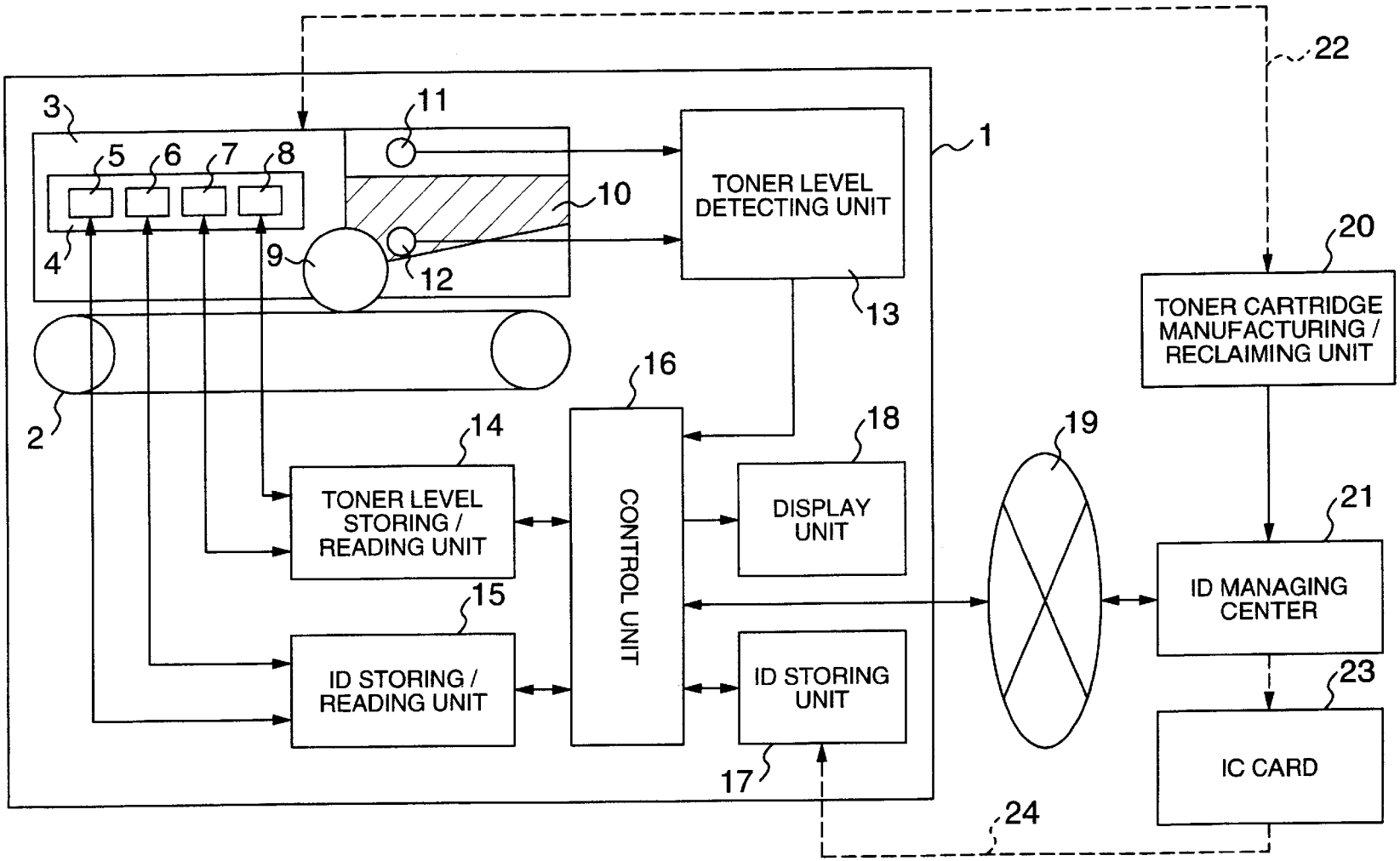
FIG. 1 is a circuit diagram showing a configuration of a toner cartridge genuine part identifying system according to an embodiment of a replacing part identifying system of the present invention.

FIG. 1 is a block diagram showing a circuit configuration of an embodiment of a toner cartridge genuine part identifying system which is used in a recording apparatus such as an electrophotographic printer or an electrophotographic copying machine as an embodiment of a replacing part containing therein a consumable and an image forming apparatus using the same of the present invention. The present invention relates to a toner cartridge genuine part identifying system which is designed in such a way that it is judged by the means for reading out an ID number, the data of the toner level, and the data of the number of times of recording or the number of sheets of used recording papers which are stored in storage means attached to a toner cartridge to carry out the comparison with respect to the data thus read out whether the toner cartridge of interest is the genuine toner cartridge or the imitation toner cartridge so that only the genuine toner cartridge can be permitted to be used.

The description will hereinbelow be given with respect to the toner cartridge genuine part identifying system shown in FIG. 1. The toner cartridge genuine part identifying system includes: a recording apparatus 1 such as an electrophotographic printer or an electrophotographic copying machine; a photosensitive member 2 for forming electrophotographically a toner image; a toner cartridge 3 to which storage means for storing therein an ID number, the hysteresis data, the data of the toner level and the data of the number of times of recording or the number of sheets of used recording papers is attached; an ID substrate 4 in which storage means such as an ID chip (a radio data carrier called an RFID) is provided; radio ID chips 5, 6, 7 and 8; a development roll 9 for transcribing toner on the photosensitive member; the toner 10; toner level sensors 11 and 12, as transmission type optical sensors, for detecting an amount of toner; a toner level detecting unit 13 for converting the data of an amount of toner into an electrical signal; a toner level storing/reading unit 14 having the function of reading out an ID number and hysteresis data of the radio ID chips 7 and 8, the function of writing the ID number and the hysteresis data of the radio ID chips 7 and 8, the function of making the ID number and the hysteresis data unable to be read out, and the like; an ID storing/reading unit 15 having the function of reading out an ID number and hysteresis data of the radio ID chips 5 and 6, the function of writing the ID number and the hysteresis data of the ID chips 5 and 6, the function of making the ID number and the hysteresis data unable to be read out, and the like; a control unit 16 for controlling the operation of inputting/outputting signals to/from the toner level detecting unit 13, the toner level storing/reading unit 14, the ID storing/reading unit 15, an ID storing unit 17, an ID managing center 21 and a display unit 18, the function of counting the number of times of recording or the number of sheets of used recording papers, the function of judging whether or not the toner cartridge is the genuine part, the operation of the present recording apparatus, and the like; the ID storing unit 17 for storing therein the toner cartridge ID number registered in the ID managing center 21, the used toner cartridge ID number, the data of the number of times of recording or the number of sheets of used recording papers, and the data of the toner level; the display unit 18 for displaying thereon the information relating to whether or not the attached toner cartridge is genuine; a communication line 19 such as a telephone line or a data communication line; a toner cartridge manufacturing/reclaiming unit 20 for carrying out the manufacture of the genuine toner cartridge, the refilling of the toner in the reclaimed toner cartridge and the exchange of the ID substrate 4; an ID managing center 21 for carrying out the storage of the sold toner cartridge's ID number and the recording apparatus number, and the toner cartridge's ID number which was used in the recording apparatus and the data of the number of times of recording or the number of sheets of used recording papers, the storage of the data of the toner level, and comparison with respect to the ID numbers based on the request made from the recording apparatus; a supply and reclamation route 22 for the toner cartridge; an IC card 23 for storing therein the ID numbers; and a supply route 24 for the IC card. By the way, as one example, the above-mentioned toner level detecting unit 13 is designed in such a way that the output level of the electrical signal is decreased as an amount of toner is reduced. In addition, for the above-mentioned toner level sensor, the magnetic sensor or the like can also be used and thus the present invention is not intended to be limited to the optical sensor as described above.

Next, a first system configuration of the present toner cartridge genuine part identifying system will hereinbelow be described with reference to FIG. 1. The present system includes the toner cartridge 3 to which the ID substrate 4 having the radio ID chip 5 provided therein is attached, the radio ID chip 5 including an identification storing unit in which the ID number is stored and a hysteresis storing unit in which the hysteresis data is stored, the ID storing/reading unit 15 having the function of reading out the ID number and the hysteresis data and the function of writing the hysteresis data, the control unit 16, the ID storing unit 17, and the display unit 18. In addition, the ID number contains the family code which is common to all of the elements and the serial number which varies every element. Also, the hysteresis data contains the new code which is common to all of the elements and the used code.

Figure 18:
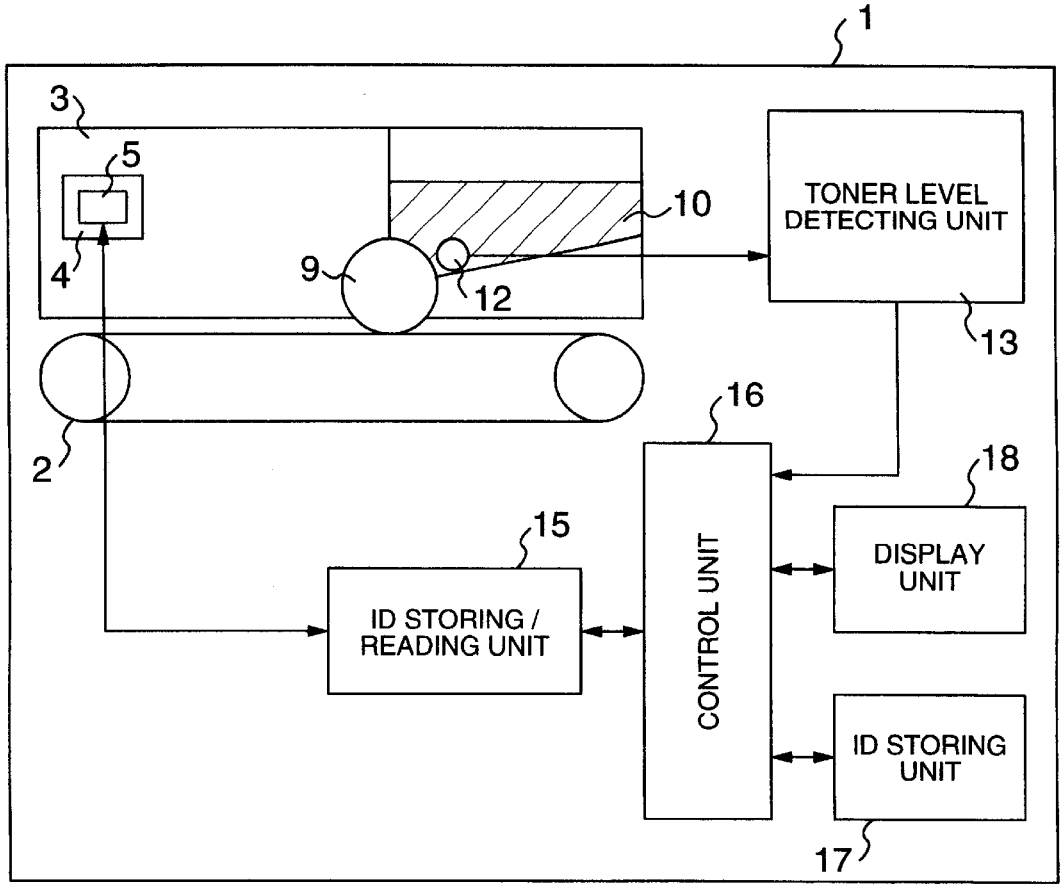
FIG. 18 is a block diagram showing a configuration of another embodiment of a toner cartridge genuine part identifying system according to the present invention.

By the way, another first system configuration is shown in FIG. 18. In such a way, the toner level detecting unit 13 may also be provided. The toner level detecting unit 13 is provided, whereby if the level of the output signal thereof has become equal to or smaller than a fixed value, then it is possible to detect that a remaining amount of toner has become little, and hence the information that it has become the time to exchange the toner cartridge or the information that the toner has been completely consumed can be displayed on the display unit 18.

First of all, at the time when the toner cartridge 3 has been attached to the recording apparatus 1, the ID storing/reading unit 15 reads out the ID number S and the hysteresis data R which are stored in the radio ID chip 5. Then, the ID number S and the hysteresis data R which have been read out are both outputted to the control unit 16. The operation thereof will hereinbelow be described.

(1) The Operation in New Use

When the ID number S and the hysteresis data R of the attached toner cartridge 3 can be read out and the family code of the ID number S matches the family code registered in the ID storing unit 17, and as a result of comparing the ID number S with the ID number registered in the ID storing unit 17, the mismatch between them is obtained, and also as a result of comparing the hysteresis data R with the hysteresis data registered in the ID storing unit 17, in the case of the new code, the control unit 16 stores the ID number S in the ID storing unit 17, and also stores therein the information that the attached toner cartridge 3 was used once. In addition, the used code is stored in the hysteresis storing unit of the radio ID chip 5 by the ID storing/reading unit 15. As a result, it is stored that the attached toner cartridge 3 was used once. Then, the recording apparatus 1 starts its recording operation.

(2) The Operation When the Toner Cartridge Used Once Was Used in Another Apparatus On the other hand, when the ID number S and the hysteresis data R of the toner cartridge 3 can be read out and the family code of the ID number S matches the family code registered in the ID storing unit 17, and as a result of comparing the ID number S with the ID number registered in the ID storing unit 17, the mismatch between them is obtained, and also as a result of comparing the hysteresis data R with the hysteresis data registered in the ID storing unit 17, in the case of the used code, since the toner cartridge of interest is the toner cartridge which was used once in another printer, the recording operation of the recording apparatus 1 is stopped to display on the display unit 18 the warning that the toner cartridge of interest is the toner cartridge other than the toner cartridge genuine part.

(3) The Operation When the Toner Cartridge Used Once Was Used in the Same Apparatus On the other hand, when the ID number S and the hysteresis data R of the toner cartridge 3 can be read out, and as a result of comparing the ID number S with the ID number registered in the ID storing unit 17, the match between them can be obtained, and as a result of comparing the hysteresis data R with the hysteresis data registered in the ID storing unit 17, in the case of the used code, the recording operation is started.

On the other hand, when the ID number S and the hysteresis data R of the toner cartridge 3 can not be read out, when the mismatch between the family codes is obtained, and when the hysteresis data R is the code other than the new code and the used code, it is judged that the toner cartridge of interest is the toner cartridge other than the genuine part, and the recording apparatus 1 stops its recording operation to display on the display unit 18 the warning that the toner cartridge of interest is the toner cartridge other than the genuine part.

Figure 19:
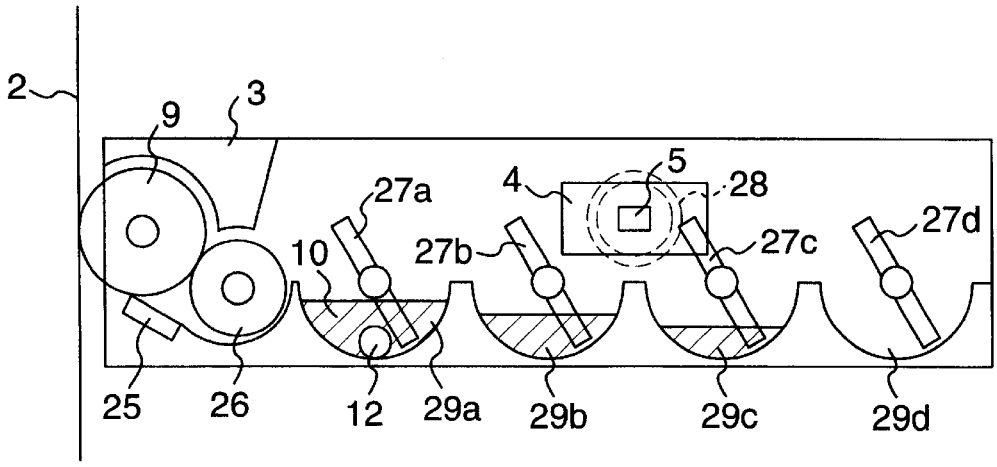
FIG. 19 is a schematic view showing construction of another embodiment of a toner cartridge according to the present invention.

Next, another embodiment of the toner cartridge used in the present toner cartridge genuine part identifying system will hereinbelow be described with reference to FIG. 19. The toner cartridge of the present embodiment includes a photosensitive member 2, a development roll 9 provided in the toner cartridge 3, a transmission type optical sensor 12 for detecting the level of the toner 10 on the basis of an amount of transmitted light, an auxiliary roll 26 for making the toner 10 adhere to the development roll 9, a blade 25 for controlling a thickness of the toner 10 on the development roll 9, semi-cylindrical accommodation units 29 for accommodating therein the toner 10, rotating paddles 27 for raking the toner 10 from the semi-cylindrical accommodation units 29, a refilling port 28 for the toner 10, and the ID substrate 4 which is fixed to the refilling port 28 and which is provided with the radio ID chip 5.

According to the present invention, since the ID substrate provided with the radio ID chip is fixed to the refilling port for the toner of the toner cartridge, when the ID substrate is intended to be peeled off to supply the imitation toner through the refilling port, the radio ID chip provided in the ID substrate is damaged by the peeling-off force. For this reason, there is offered the effect that this toner cartridge can be disabled on and after the next time. In such a way, when the configuration is adopted in which the ID number and the like are read out in the radio manner, since if the radio ID chip 5 is present within a predetermined range, then the ID number and the like can be read out, even if the shape of the refilling port varies, the above-mentioned configuration can be applied thereto.

By the way, the toner cartridge used in the present toner cartridge genuine part identifying system can also be applied even in the toner cartridge having the different development system other than the foregoing.

In addition, the ID number of the radio ID chip of the above-mentioned system may also be formed with the serial number which varies every element. In this case, the above-mentioned system is configured in such a way that the judgement for the family code is omitted.

In addition, in order to prevent the data from being able to be altered dishonestly, the radio ID chip including a ROM for storing therein the ID number and an additional storage type nonvolatile memory for storing therein the hysteresis data is suitable for the radio ID chip of the above-mentioned system.

According to the present invention, there is offered the effect that after the toner cartridge 3 has been used until a remaining amount of toner has become little or the toner has been completely consumed, the toner can be refilled and the ID substrate 4 can be exchanged by the toner cartridge manufacturing/reclaiming units 20 to resupply the resultant toner cartridge to the market through the reclamation/supply route 22.

In addition, since it is stored in the radio ID chip 5 that the toner cartridge was used once, there is offered the effect that it is possible to exclude the use of the toner cartridge, which has been resupplied after completion of the refilling of the imitation toner without exchanging the ID substrate 4, other than the genuine part.

Next, a second system configuration of the present toner cartridge genuine part identifying system will hereinbelow be described with reference to FIG. 1. The present system includes: the toner cartridge 3 to which the ID substrate 4 having the radio ID chip 5 provided therein is attached; the radio ID chip 5 including an identification storing unit in which the ID number is stored, a hysteresis storing unit in which the hysteresis data is stored and a control storing unit in which a control flag used to stop the operation of reading out the hysteresis data is stored; the ID storing/reading unit 15 having the function of reading out the ID number and the hysteresis data and the function of outputting a code which is used to stop the operation of reading out the hysteresis data; the control unit 16; the ID storing unit 17; and the display unit 18. In addition, the ID number contains the family code which is common to all of the elements and the serial number which varies every element. Also, the hysteresis data is the code which is common to all of the radio ID chips. Then, at the time when the code which is used to stop the reading operation has been inputted to the radio ID chip, the stop flag is stored in the control storing unit so that the operation of reading out the hysteresis data on and after the storage of the stop flag can be stopped.

By the way, another second system can be configured with reference to FIG. 18. In such a way, the toner level detecting unit 13 may also be provided. The toner level detecting unit 13 is provided, whereby at the time when the level of the output signal thereof has become equal to or smaller than the fixed value, it can be detected that a remaining amount of toner has become little, and hence the warning that it has become the time to exchange the toner cartridge or the warning that the toner has been completely consumed can be displayed on the display unit 18.

First of all, at the time when the toner cartridge 3 has been attached to the recording apparatus 1, the ID storing/reading unit 15 reads out the ID number S and the hysteresis data R which are stored in the radio ID chip 5. The ID number S and the history data R which have been read out are both outputted to the control unit 16. The operation thereof will hereinbelow be described.

(1) The Operation in New Use

When the ID number S and the hysteresis data R of the attached toner cartridge 3 can be read out, and the family code of the ID number S matches the family code registered in the ID storing unit 17, and as a result of comparing the ID number S with the ID number registered in the ID storing unit 17, the mismatch between them is obtained, while as a result of comparing the hysteresis data R with the hysteresis data registered in the ID storing unit 17, the match between them can be obtained, the control unit 16 stores the ID number S in the ID storing unit 17 to store therein that the attached toner cartridge was used once. In addition, in order to prevent the hysteresis data from being able to be read out by the ID storing/reading unit 15, the code which is used to stop the operation of reading out the hysteresis data is outputted to the radio ID chip 5, and the stop flag is stored in the control storing unit. As a result, it is stored that the attached toner cartridge was used once. Then, the recording apparatus 1 starts its recording operation.

(2) The Operation When the Toner Cartridge Used Once Was Used in Another Apparatus On the other hand, when the ID number S of the toner cartridge 3 can be read out, and the family code of the ID number S matches the family code registered in the ID storing unit 17, and as a result of comparing the ID number S with the ID number registered in the ID storing unit 17, the mismatch between them is obtained, and also the hysteresis data R can not be read out, the recording operation of the recording apparatus 1 is stopped. Also, since the toner cartridge of interest is the toner cartridge which was used in another printer once, the warning that the toner cartridge of interest is the toner cartridge other than the genuine part is displayed on the display unit 18.

(3) The Operation When the Toner Cartridge Used Once Was Used in the Same Apparatus On the other hand, when the ID number S of the toner cartridge 3 can be read out, and as a result of comparing the ID number S with the ID number registered in the ID storing unit, the match between them can be obtained, and also the hysteresis data R can not be read out, the recording operation is started.

On the other hand, when the ID number S of the toner cartridge can not be read out, when the family code of the ID number S does not match the family code and when the code of interest is the code other than the hysteresis data, it is judged that the toner cartridge of interest is the toner cartridge other than the genuine part, and the recording apparatus 1 stops its recording operation to display on the display unit 18 the warning that the toner cartridge of interest is the toner cartridge other than the genuine part.

By the way, the ID number of the radio ID chip of the above-mentioned system may also be formed with the serial number which varies every element. In this case, the above-mentioned system is configured in such a way that the judgement for the family code is omitted.

In addition, in order to prevent the data from being able to be altered dishonestly, the radio ID chip including a ROM for storing therein the ID number and the hysteresis data and an additional storage type nonvolatile memory for storing therein the stop flag is suitable for the radio ID chip of the above-mentioned system.

According to the present invention, there is offered the effect that after the toner cartridge has been used until a remaining amount of toner has become little or the toner has been completely consumed, the toner can be refilled and the ID substrate 4 can be exchange by the toner cartridge manufacturing/reclaiming unit 20 to resupply the resultant toner cartridge to the market through the reclamation/supply route 22.

In addition, since it is stored in the radio ID chip 5 that the toner cartridge was used once, there is offered the effect that it is possible to exclude the use of the toner cartridge, which has been resupplied after completion of the refilling of the imitation toner without exchanging the ID substrate 4, other than the genuine part.

Next, a third system configuration of the present toner cartridge genuine part identifying system will hereinbelow be described with reference to FIG. 1. The present system includes: the toner cartridge 2 to which the ID substrate 4 having a plurality of radio chips 5 and 6 provided therein is attached; the radio ID chips 5 and 6 each including the identification storing unit for storing therein the ID number; the ID storing/reading unit 15 having the function of reading out the ID number and the function of breaking down electrically or mechanically the radio ID chip for the purpose of preventing the ID number from being able to be read out; the control unit 16; the ID storing unit 17; and the display unit 18. The ID number of each of the radio ID chips 5 and 6 contains the family code which is common to all of the elements, and the serial number which varies every element.

Figure 20:
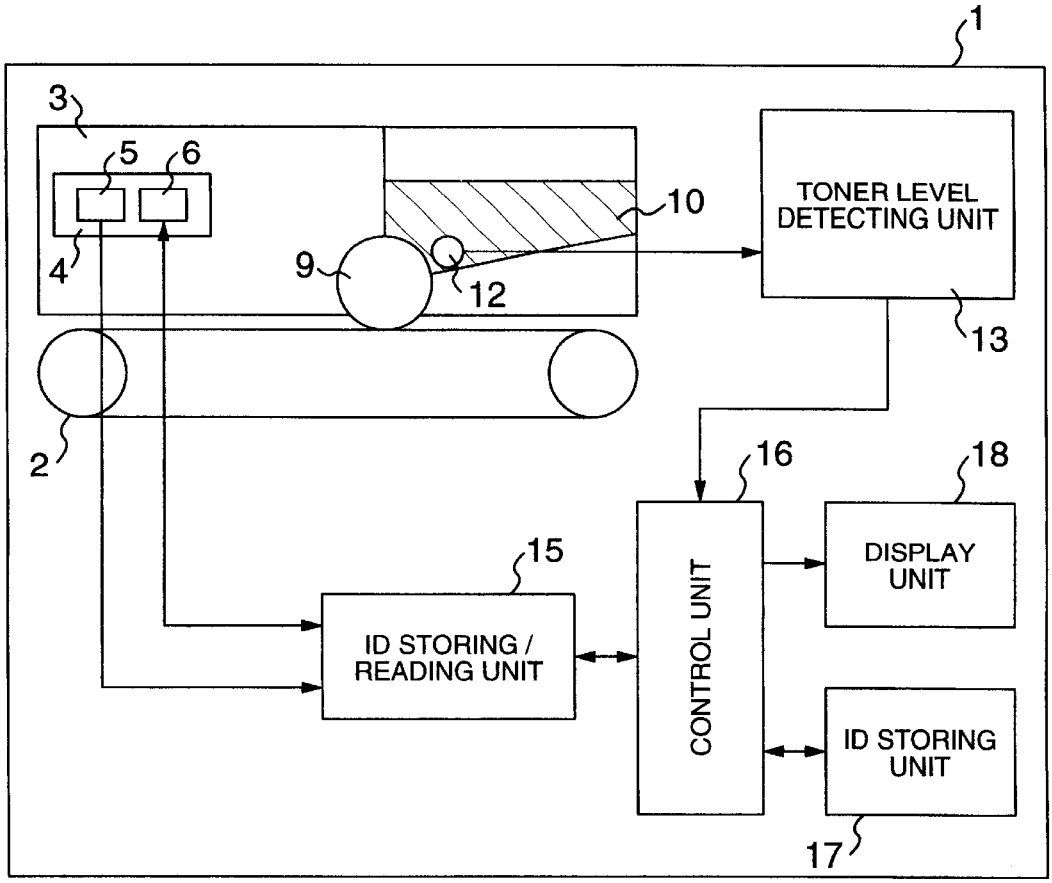
FIG. 20 is a block diagram showing a configuration of still another embodiment of a toner cartridge genuine part identifying system according to the present invention.

By the way, another third system configuration is shown in FIG. 20. In such a way, the toner level detecting unit 13 may also be provided. The toner level detecting unit 13 is provided, whereby at the time when the level of the output signal thereof has become equal to or smaller than a fixed value, it is possible to detect that a remaining amount of toner has become little, and the warning that it has become the time to exchange the toner cartridge or the warning that the toner has been completely consumed can be displayed on the display unit 18.

First if all, at the time when the toner cartridge 3 has been attached to the recording apparatus 1, the ID storing/reading unit 15 reads out the ID numbers S and X which are respectively stored in the ratio ID chips 5 and 6. Then, the ID numbers S and X which have been read out are outputted to the control unit 16. The operation thereof will hereinbelow be described.

(1) The Operation in New Use

When the ID numbers S and X of the attached toner cartridge 3 can be read out, and the family code of each of the ID numbers S and X matches the family code stored in the ID storing unit 17, and also as a result of comparing the ID number S with the ID number stored in the ID storing unit 17, the mismatch between them is obtained, the control unit 16 stores the ID number S in the ID storing unit 17 and it is stored that the attached toner cartridge 3 was used once. In addition, in order to prevent the ID number X from being able to be read out by the ID storing/reading unit 15, the radio ID chip 6 is broken down electrically or mechanically. As a result, it is stored that the attached toner cartridge 3 was used once. Then, the recording apparatus 1 starts its recording operation.

(2) The Operation When the Toner Cartridge Used Once Was Used Another Apparatus

On the other hand, when the ID number S of the toner cartridge 3 can be read out, and the family code of the ID number S matches the family code stored in the ID storing unit 17, and as a result of comparing the ID number S with the ID number stored in the ID storing unit 17, the mismatch between them is obtained, and also the ID number X can not be read out, the recording apparatus 1 stops its recording operation. Then, since the toner cartridge of interest is the toner cartridge which was used in another printer once, the warning that the toner cartridge of interest is the toner cartridge other than the toner cartridge genuine part is displayed on the display unit 18.

(3) The Operation When the Toner Cartridge Used Once Was Used in the Same Apparatus On the other hand, when the ID number S of the toner cartridge 3 can be read out, and as a result of comparing the ID number S with the ID number stored in the ID storing unit 17, the match between them can be obtained, and also the ID number X can not be read out, the recording operation is started.

On the other hand, when the ID number S of the toner cartridge 3 can not be read or when the family code of each of the ID numbers S and X does not match the family code stored in the ID storing unit 17, it is judged that the toner cartridge of interest is the toner cartridge other than the genuine part, and the recording apparatus 1 stops its recording operation to display on the display unit 18 the warning that the toner cartridge of interest is the toner cartridge other than the genuine part.

By the way, the ID number of the radio ID chip of the above-mentioned system may also be formed with the serial number which varies every element. In this case, the above-mentioned system is configured in such a way that the judgement for the family code is omitted.

In addition, it is suitable for the radio ID chip of the above-mentioned system to use the radio ID chip which is adapted to store the ID number in a ROM.

According to the present invention, there is offered the effect that after the toner cartridge has been used until a remaining amount of toner has become little or the toner has been completely consumed, the toner can be refilled and the ID substrate 4 can be exchanged by the toner cartridge manufacturing/reclaiming unit 20 to resupply the resultant toner cartridge to the market through the reclamation/supply route 22.

In addition, since it is stored in the radio ID chip 6 that the toner cartridge was used once, there is offered the effect that it is possible to exclude the use of the toner cartridge, which has been resupplied after completion of the refilling of the imitation toner without exchanging the ID substrate 4, other than the genuine part.

Next, a fourth system configuration of the present toner cartridge genuine part identifying system will hereinbelow be described with reference to FIG. 1. The present system includes: the toner cartridge 3 to which the ID substrate 4 having a plurality of radio ID chips 5 and 6 provided therein is attached; the radio ID chip 5 including the identification storing unit in which the ID number is stored; the radio ID chip 6 including an identification storing unit in which the ID number is stored and a control storing unit in which a control flag used to stop the operation of reading out the ID number is stored; the ID storing/reading unit 15 having the function of reading out the ID number and the function of outputting a code which is used to stop the operation of reading out the ID number; the control unit 16; the ID storing unit 17; and the display unit 18. The ID number of each of the radio ID chips 5 and 6 includes the family code which is common to all of the elements and the serial number which varies every element.

By the way, another fourth system may also be configured with reference to FIG. 20. In Such a way, the toner level detecting unit 13 may also be provided. The toner level detecting unit 13 is provided, whereby at the time when the level of the output signal thereof has become equal to or lower than a fixed value, it can be detected that a remaining amount of toner has become little, and the warning that it has become the time to exchange the toner cartridge or the warning that the toner has become completely consumed can be displayed on the display unit.

First of all, at the time when the toner cartridge 3 has been attached to the recording apparatus 1, the ID storing/recording unit 15 reads out the ID numbers S and X which are respectively stored in the radio ID chips 5 and 6. Then, the ID numbers S and X which have been read out are outputted to the control unit 16. The operation thereof will hereinbelow be described.

(1) The Operation in New Use

When the ID numbers S and X of the toner cartridge 3 can be read out, and the family code of each of the ID numbers S and X matches the family code stored in the ID storing unit 17, and also as a result of comparing the ID number S with the ID number stored in the ID storing unit 17, the mismatch between them is obtained, the control unit 16 stores the ID number S in the ID storing unit 17 and also it is stored that the attached toner cartridge 3 was used once. In addition, in order to prevent the ID number X from being able to be read out by the ID storing/reading unit 15, the code which is used to stop the operation of reading out the ID number is outputted to the radio ID chip 6, and the stop flag is stored in the control storing unit. As a result, it is stored that the attached toner cartridge 3 was used once. Then, the recording apparatus 1 starts its recording operation.

(2) The Operation When the Toner Cartridge Used Once Was Used in Another Apparatus On the other hand, when the ID number S of the toner cartridge 3 can be read out, and the family code of the ID number S matches the family code stored in the ID storing unit 17, and as a result of comparing the ID number S with the ID number stored in the ID storing unit 17, the mismatch between them is obtained, and also the ID number X can not be read out, the recording apparatus 1 stops its recording operation. Thus, since the toner cartridge of interest is the toner cartridge which was used in another printer once, the warning that the toner cartridge of interest is the toner cartridge other than the genuine part is displayed on the display unit 18.

(3) The Operation When the Toner Cartridge Used Once Was Used in the Same Apparatus On the other hand, when the ID number S of the toner cartridge 3 can be read out, and as a result of comparing the ID number S with the ID number stored in the ID storing unit 17, the match between them can be obtained, and also the ID number X can not be read out, the recording operation is started.

On the other hand, when the ID number S of the toner cartridge 3 can not be read out or when the family code of each of the ID numbers S and X does not match the family code stored in the ID storing unit 17, it is judged that the toner cartridge of interest is the toner cartridge other than the genuine part, and the recording apparatus 1 stops its recording operation to display on the display unit 18 the warning that the toner cartridge of interest is the toner cartridge other than the genuine part.

By the way, the ID numbers of the radio ID chips of the above-mentioned system may also be formed with the serial numbers which differ from one element to another. In this case, the above-mentioned system is configured in such a way that the judgement for the family code is omitted.

In addition, it is suitable for the radio ID chip of the above-mentioned system to use the radio ID chip in which the ID number is stored in a ROM and the stop flag is stored in an additional storage type nonvolatile memory.

According to the present invention, there is offered the effect that after the toner cartridge has been used until a remaining amount of toner has become little or the toner has been completely consumed, the toner can be refilled and the ID substrate 4 can be exchanged by the toner cartridge manufacturing/reclaiming unit 20 to resupply the resultant toner cartridge to the market through the reclamation/supply route 22.

In addition, since it is stored in the radio ID chip 6 that the toner cartridge was used once, there is offered the effect that it is possible to exclude the use of the toner cartridge, which has been resupplied after completion of the refilling of the imitation toner without exchanging the ID substrate 4, other than the genuine part.

Next, a fifth system configuration of the present toner cartridge genuine part identifying system will hereinbelow be described with reference to FIG. 1. The present system includes: the toner cartridge 3 to which the ID substrate 4 having the radio ID chip 5 provided therein is attached; the radio ID chip 5 including an identification storing unit in which the ID number is stored and a hysteresis storing unit in which the hysteresis data is stored; the ID storing/reading unit 15 having the function of reading out the ID number and the hysteresis data and the function of writing the hysteresis data; the control unit 16; the ID storing unit 17; and the display unit 18. In addition, the ID number contains the family code which is common to all of the elements and the serial number which varies every element. In addition, with respect to the hysteresis data, if the number of times of recording or the number of sheets of used recording papers has exceeded N1, then an N1 code is written to be stored by the ID storing/reading unit 15, while if the number of times of recording or the number of sheets of used recording papers has exceeded N2, then an N2 code is written to be stored by the ID storing/reading unit 15. By the way, when the printer is shipped, the number of times of recording or the number of sheets of used recording papers is zero, and hence an N0 code of zero is written thereto.

In this connection, another fifth system may be configured with reference to FIG. 18. In such a way, the toner level detecting unit 13 may also be provided. The toner level detecting unit 13 is provided, whereby at the time when the level of the output signal thereof has become equal to or smaller than a fixed value, it can be detected that a remaining amount of toner has become little, and also the warning that it has become the time to exchange the toner cartridge or the warning that the toner has been completely consumed can be displayed on the display unit 18.

First of all, at the time when the toner cartridge 3 has been attached to the recording apparatus 1, the ID storing/reading unit 15 reads out the ID number S and the hysteresis data R which are stored in the radio ID chip 5. The ID number S and the hysteresis data R which have been read out are outputted to the control unit 16. In addition, the number of times of recording or the number of sheets of used recording papers is counted by the control unit 16. The operation thereof will hereinbelow be described.

(1) The Operation in New Use

When the ID number S and the hysteresis data R of the attached toner cartridge 3 can be read out, and the family code of the ID number S matches the family code registered in the ID storing unit 17, and when the ID number S is compared with the ID number registered in the ID storing unit 17, and as a result the mismatch between them is obtained, the control unit 16 stores the ID number S in the ID storing unit 17 to start the recording operation of the recording apparatus 1. Then, the number of times of recording or the number of sheets of used recording papers is counted with as an initial value the number of times of recording or the number of sheets of used recording papers with respect to the read-out hysteresis data R to store the counted value in the ID storing unit 17 in correspondence to the ID number S. Then, if the number of times of recording or the number of sheets of used recording papers has exceeded a setting value N1 or N2, then an N1 code or an N2 code is outputted to the radio ID chip 5 by the ID storing/reading unit 15 to be stored in the hysteresis storing unit. By the way, if the number of times of recording or the number of sheets of used recording papers has become equal to N2, then the recording operation is stopped to display on the display unit 18 the warning that the toner cartridge of interest is the toner cartridge other than the genuine part and the warning that it has become the time to exchange the toner cartridge.

(2) The Operation When the Toner Cartridge Used Once Was Used in the Same Apparatus On the other hand, when the ID number S and the hysteresis data R of the toner cartridge 3 can be read out, and as a result of comparing the ID number S with the ID number registered in the ID storing unit 17, the match between them can be obtained, the recording operation of the recording apparatus 1 is started. Then, the number of times of recording or the number of sheets of used recording papers with respect to the read-out hysteresis data R is compared with the number of times of recording or the number of sheets of used recording papers the data of which is stored in correspondence to the ID number S of the ID storing unit 17, and the number of times of recording or the number of sheets of used recording papers is counted with larger one as an initial value and the data thereof is stored in the ID storing unit 17 in correspondence to the ID number S. Then, if the number of times of recording or the number of sheets of used recording papers has exceeded the setting value N1 or N2, then the N1 code or the N2 code is outputted to the radio ID chip 5 by the ID storing/reading unit 15 to be stored in the hysteresis storing unit. By the way, if the number of times of recording or the number of sheets of used recording papers has become equal to N2, then the recording operation is stopped to display on the display unit 18 the warning that the toner cartridge of interest is the toner cartridge other than the genuine part and the warning that it has become the time to exchange the toner cartridge on the display unit 18.

On the other hand, when the family code of the ID number S of the toner cartridge 3 does not match the family code stored in the ID storing unit 17 and when the ID number S of the toner cartridge can be read out, it is judged that the toner cartridge of interest is the toner cartridge other than the genuine part, and the recording apparatus 1 stops its recording operation to display on the display unit 18 the warning that the toner cartridge of interest is the toner cartridge other than the genuine part.

By the way, the ID numbers of the radio ID chips of the above-mentioned system may also be formed with the serial numbers which differ from one element to another. In this case, the above-mentioned system is configured in such a way that the judgement for the family code is omitted.

In addition, in order to prevent the data from being able to be altered dishonestly, a radio ID chip including a ROM in which the ID number is stored and an additional storage type nonvolatile memory in which the hysteresis data is stored is suitable for the radio ID chip of the above-mentioned system.

According to the present invention, there is offered the effect that after the toner cartridge 3 has been used until a remaining amount of toner has become little or the toner has been completely consumed, the toner can be refilled and the ID substrate 4 can be exchanged by the toner cartridge manufacturing/reclaiming unit 20 to resupply the resultant toner cartridge to the market through the reclamation/supply route 22.

In addition, since the data of the number of times of recording or the number of sheets of used recording papers is stored in the radio ID chip 5, it is possible to detect necessarily the number of times of recording or the number of sheets of used recording papers which was set. Therefore, there are offered the effect that the toner cartridge which was used once can be used in another recording apparatus and the effect that it is possible to exclude the use of the toner cartridge, which has been resupplied after completion of the refilling of the imitation toner, other than the genuine part.

In addition, if the number N2 of times of recording or the number N2 of sheets of used recording papers is set equal to or larger than 1.5 times as large as the allowable number of times of recording or the allowable number of sheets of used recording papers, then there is offered the effect that it is possible to solve the problem that the number of times of recording or the number of sheets of used recording papers until the stop of recording is reduced due to the fluctuation of a consumed amount of toner depending on the kinds of images.

In addition, as another embodiment, after the number of times of recording or the number of sheets of used recording papers has become N2 and then the number of times of recording or the number of sheets of used recording papers has become N3 (the total N2+N3), the recording operation is stopped. For example, if the number N2 of times of recording or the number N2 of sheets of used recording papers is set to the allowable number of times of recording or the allowable number of sheets of used recording papers, and N3 is set to half the allowable number of times of recording or the allowable number of sheets of used recording papers, then there is offered the effect that it is possible to solve the problem that the number of times of recording or the number of sheets of used recording papers until the stop of recording is reduced due to the fluctuation of a consumed amount of toner depending on the kinds of images.

By the way, while in the above-mentioned system, the setting values for the number of times of recording or the number of sheets of used recording papers are N1 and N2, it is also possible to increase further the number of setting values for the number of times of recording or the number of sheets of used recording papers. As a result, there is offered the effect that it is possible to obtain more accurately a time point when a remaining amount of toner has become little or the toner has been completely consumed. Further, there is offered the effect that it is possible to manage more finely the dishonest manipulation such as the refilling of the imitation toner.

Next, a sixth system configuration of the present toner cartridge genuine part identifying system will hereinbelow be described with reference to FIG. 1. The present system includes: the toner cartridge 3 to which the ID substrate 4 having the radio ID chip 5 provided therein is attached; the radio ID chip 5 including an identification storing unit in which the ID number is stored, a hysteresis storing unit in which the hysteresis data is stored, and a control storing unit in which a control flag used to select the operation of read out the hysteresis data is stored; the ID storing/reading unit 15 having the function of reading out the ID number and the hysteresis data, and the function of outputting the code which is used to select the operation of reading out the hysteresis data; the control unit 16; the ID storing unit 17; and the display unit 18. In addition, the ID number contains the family code which is common to all of the elements and the serial number which varies every element. On the other hand, the hysteresis data exhibits the number of times of recording or the number of sheets of used recording papers and is the code which is common to all of the radio ID chips. If the number of times of recording or the number of sheets of used recording papers has exceeded N1 or N2, then the ID storing/reading unit 15 outputs the code which is used to select the operation of recording out the hysteresis data and stores the selection flag in the control storing unit. The hysteresis storing unit, in correspondence with the selection flag, outputs an N1 code in which the number of times of recording or the number of sheets of used recording papers corresponds to N1, and an N2 code in which the number of times of recording or the number of sheets of used recording papers corresponds to N2. In addition, when the printer is shipped, the hysteresis storing unit outputs an N0 code exhibiting that the number of times of recording or the number of sheets of used recording papers is zero.

By the way, another sixth system may be configured with reference to FIG. 18. In such a way, the toner level detecting unit 13 may also be provided. The toner level detecting unit 13 is provided, whereby if the level of the output signal has become equal to or smaller than a fixed value, then it is possible to detect that a remaining amount of toner has become little and also it is possible to display on the display unit 18 the warning that it has become the time to exchange the toner cartridge or the toner has been completely consumed.

First of all, at the time when the toner cartridge has been attached to the recording apparatus 1, the ID storing/reading unit 15 reads out the ID number S and the hysteresis data R which are stored in the radio ID chip 5. Then, the ID number S and the hysteresis data R which have been read out are outputted to the control unit 16. In addition, the control unit 16 counts the number of times of recording or the number of sheets of used recording papers. The operation thereof will hereinbelow be described.

(1) The Operation in New Use

When the ID number S and the hysteresis data R of the attached toner cartridge 3 can be read out, and the family code of the ID number S matches the family code registered in the ID storing unit 17, and as a result of comparing the ID number S with the ID number registered in the ID storing unit 17, the mismatch between them is obtained, the control unit 16 stores the ID number S in the ID storing unit 17 to start the recording operation of the recording apparatus 1. Then, the number of times of recording or the number of sheets of used recording papers is counted with as an initial value the number of times of recording or the number of sheets of used recording papers with respect to the read-out hysteresis data R and the data thereof is stored in the ID storing unit 17 in correspondence to the ID number S. Then, if the number of times of recording or the number of sheets of used recording papers has exceeded the setting value N1 or N2, the code which is used to select the operation of reading out the hysteresis data is outputted to the radio ID chip 5 by the ID storing/reading unit 15 and the selection flag is stored in the control storing unit. By the way, if the number of times of recording or the number of sheets of used recording papers has become equal to N2, then the recording operation is stopped to display on the display unit 18 the warning that the toner cartridge of interest is the toner cartridge other than the genuine part and the warning that it has become the time to exchange the toner cartridge.

(2) The Operation When the Toner Cartridge Used Once Was Used in the Same Apparatus On the other hand, when the ID number S and the hysteresis data R of the toner cartridge 3 can be read out, and as a result of comparing the ID number S with the ID number registered in the ID storing unit 17, the match between them can be obtained, the recording operation of the recording apparatus 1 is started. Then, the number of times of recording or the number of sheets of used recording papers with respect to the read-out hysteresis data R is compared with the number of times of recording or the number of sheets of used recording papers the data of which is stored in correspondence to the ID number S in the ID storing unit 17, and then the number of times of recording or the number of sheets of used recording papers is counted with larger one as an initial value and the data thereof is stored in the ID storing unit 17 in correspondence to the ID number S. Then, if the number of times of recording or the number of sheets of used recording papers has exceeded the setting value N1 or N2, then the code which is used to select the operation of reading out the hysteresis data is outputted to the radio ID chip 5 by the ID storing/reading unit 15 to store the selection flag in the control storing unit. By the way, if the number of times of recording or the number of sheets of used recording papers has become N2, then the recording operation is stopped to display on the display unit 18 the warning that the toner cartridge other than the genuine part is prohibited from being used and the warning that it has become the time to exchange the toner cartridge.

On the other hand, when as a result of comparing the family code of the ID number S of the toner cartridge 3 with the family code of the toner cartridge ID number registered in the ID storing unit 17, the mismatch between them is obtained and when the ID number S of the toner cartridge 3 can not be read out, it is judged that the toner cartridge of interest is the toner cartridge other than the genuine part and then the recording apparatus 1 stops its recording operation to display on the display unit 18 the warning that the toner cartridge other than the genuine part is prohibited from being used.

By the way, the ID numbers of the radio ID chips of the above-mentioned system may also be formed with the serial numbers which differ from one element to another. In this case, the above-mentioned system is configured in such a way that the judgement for the family code is omitted.

In addition, in order to prevent the data from being able to be altered dishonestly, a radio ID chip including a ROM in which the ID number and the hysteresis data are stored and an additional storage type nonvolatile memory in which the stop flag is stored is suitable for the radio ID chip of the above-mentioned system.

According to the present invention, there is offered the effect that after the toner cartridge 3 has been used until a remaining amount of toner has become little or the toner has been completely consumed, the toner can be refilled and the ID substrate 4 can be exchanged by the toner cartridge manufacturing/reclaiming unit 20 to resupply the resultant toner cartridge to the market through the reclamation/supply route 22.

In addition, since the data of the number of times of recording or the number of sheets of used recording papers is stored in the radio ID chip 5, there are offered the effect that the toner cartridge which was used once can be used in another recording apparatus, and the effect that it is possible to exclude the use of the toner cartridge, which has been resupplied after completion of the refilling of the imitation toner, other than the genuine part.

In addition, if the number N2 of times of recording or the number N2 of sheets of used recording papers is set equal to or larger than 1.5 times as large as the allowable number of times of recording or the allowable number of sheets of used recording papers, then it is possible to solve the problem that the number of times of recording or the number of sheets of used recording papers until the stop of recording is reduced due to the fluctuation of a consumed amount of toner depending on the kinds of images.

In addition, as another embodiment, after the number of times of recording or the number of sheets of used recording papers has become N2 and then reaches N3 (the total N2+N3), the recording operation is stopped. For example, if the number N2 of times of recording or the number N2 of sheets of used recording papers is set to the allowable number of times of recording or the allowable number of sheets of used recording papers, and also N3 is set to half the allowable number of times of recording or the allowable number of sheets of used recording papers, then there is offered the effect that it is possible to solve the problem that the number of times of recording or the number of sheets of used recording papers until the stop of recording is reduced due to the fluctuation of a consumed mount of toner depending on the kinds of images.

By the way, while in the above-mentioned system, the setting values for the number of times of recording or the number of sheets of used recording papers are N1 and N2, it is possible to increase further the number of setting values for the number of times of recording or the number of sheets of used recording papers. As a result, there is offered the effect that it is possible to obtain more accuracy a time point when a remaining amount of toner has become little or the toner has been completely consumed. In addition, there is offered the effect that it is possible to manage more finely the dishonest manipulation such as the refilling of the imitation toner.

Next, a seventh system configuration of the present toner cartridge genuine port identifying system will hereinbelow be described with reference to FIG. 1. The present system includes: the toner cartridge 1 to which the ID substrate 4 having a plurality of radio ID chips 5, 7 and 8 provided therein is attached; the radio ID chips 5, 7 and 8 each including the identification storing unit in which the ID number is stored; the toner level storing/reading unit 14 having the function of reading out the ID number and the function of breaking down electrically or mechanically the radio ID chip for the purpose of preventing the ID number from being able to be read out; the ID storing/reading unit 15 having the function of reading out the ID number; the control unit 16; the ID storing unit 17; and the display unit 18. The ID number of each of the radio ID chips 5, 7 and 8 contains the family code which is common to all of the elements and the serial number which varies every element. By the way, each of the radio ID chips 7 and 8 exhibits the number of times of recording or the number of sheets of used recording papers. Then, it is assumed that when the ID numbers of both of them can be read out, the number of times of recording or the number of sheets of used recording papers is zero, when the ID number of one of them can be read out, the number of times of recording or the number of sheets of used recording papers is N1, and when the ID numbers of none of them can be read out, the number of times of recording or the number of sheets of used recording papers is N2.

Figure 21:
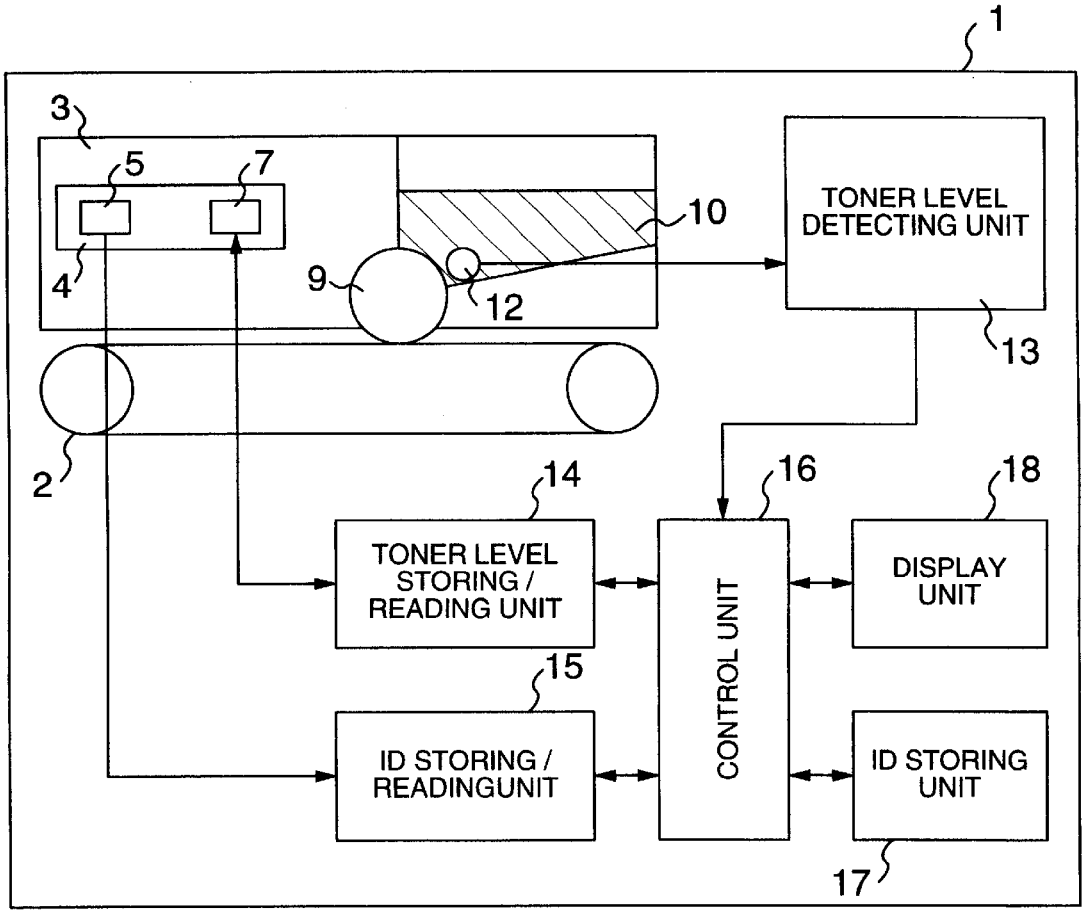
FIG. 21 is a block diagram showing a configuration of yet another embodiment of a toner cartridge genuine part identifying system according to the present invention.

By the way, another seventh system configuration is shown in FIG. 21. In such a way, the two radio ID chips 5 and 7 may also be provided.

First of all, at the time when the toner cartridge 3 has been attached to the recording apparatus 1, the ID storing/reading unit 15 and the toner level storing/reading unit 14 read out the ID numbers S, Y and Z which are respectively stored in the radio ID chips 5, 7 and 8. The ID numbers S, Y and Z which have been read out are outputted to the control unit 16. In addition, the number of times of recording or the number of sheets of used recording papers is counted by the control unit 16. The operation thereof will hereinbelow be described.

(1) The Operation in New Use

When the ID numbers S, Y and Z of the toner cartridge 3 can be read out, and the family code of each of the ID numbers S, Y and Z matches the family code stored in the ID storing unit 17, and also as a result of comparing the ID number S with the ID number stored in the ID storing unit 17, the mismatch between them is obtained, the control unit 16 stores the ID number S in the ID storing unit 17 to start the recording operation of the recording apparatus 1. Then, the number of times of recording or the number of sheets of used recording papers is counted with as an initial value the number of times of recording or the number of sheets of used recording papers with respect to the read-out ID number Y and Z and the data thereof is stored in the ID storing unit 17 in correspondence to the ID number S. Then, if the number of times of recording or the number of sheets of used recording papers has exceeded the setting value N1 or N2, the radio ID chips 7 or 8 are electrically or mechanically broken down for the purpose of preventing the ID number Y or Z from being able to be read out by the toner level storing/reading unit. By the way, if the number of times of recording or the number of sheets of used recording papers has become equal to the setting value N2, then the recording operation is stopped to display on the display unit 18 the warning that the toner cartridge other than the genuine part is prohibited from being used and the warning that it has become the time to exchange the toner cartridge.

(2) The Operation When the Toner Cartridge Used Once Was Used in the Same Apparatus On the other hand, when the ID numbers S and Y or Z of the toner cartridge 3 can be read out, and the family code of each of the ID numbers S and Y or Z matches the family code stored in the ID storing unit 17, and also as a result of comparing the ID number S with the ID number registered in the ID storing unit 17, the match between them can be obtained, the recording operation of the recording apparatus 1 is started. Then, the number of times of recording or the number of sheets of used recording papers with respect to the read-out ID number Y and Z is compared with the number of times of recording or the number of sheets of used recording papers the data of which is stored in correspondence to the ID number S in the ID storing unit 17, and the number of times of recording or the number of sheets of used recording papers is counted with larger one as an initial value and the data thereof is stored in the ID storing unit 17 in correspondence to the ID number S. Then, if the number of times of recording or the number of sheets of used recording papers has exceeded the setting value N1 or N2, then the radio ID chips 7 or 8 are electrically or mechanically broken down for the purpose of preventing the ID number Y or Z from being able to be read out by the toner level storing/reading unit 14. By the way, if the number of times of recording or the number of sheets of used recording papers has become equal to N2, then the recording operation is stopped to display on the display unit 18 the warning that the toner cartridge other than the genuine part is prohibited from being used and the warning that it has become the time to exchange the toner cartridge.

On the other hand, when as a result of comparing the family code of each of the ID numbers S, Y and Z of the toner cartridge 3 with the family code of the toner cartridge ID number registered in the ID storing unit 17, the mismatch between them is obtained, and when the ID number S can not be read out, and also when the ID number Y or Z can not be read out, it is judged that the toner cartridge of interest is the toner cartridge other than the genuine part, and then the recording apparatus 1 stops its recording operation to display on the display unit 18 the warning that the toner cartridge of interest is the toner cartridge other than the genuine part.

By the way, the ID numbers of the radio ID chips of the above-mentioned system may also be formed with the serial numbers which differ from one element to another. In this case, the above-mentioned system is configured in such a way that the judgement for the family code is omitted.

In addition, it is suitable for the radio ID chip of the above-mentioned system to use the radio ID chip in which the ID number is stored in a ROM.

According to the present invention, there is offered the effect that after the toner cartridge 3 has been used until a remaining amount of toner has become little or the toner has been completely consumed, the toner can be refilled and the ID substrate 4 can be exchanged by the toner cartridge manufacturing/reclaiming unit 20 to resupply the resultant toner cartridge to the market through the reclamation/supply route 22.

In addition, since the data of the number of times of recording or the number of sheets of used recording papers is stored in the radio ID chips 7 and 8, there is offered the effect that the number of times of recording or the number of sheets of used recording papers which was set can be necessarily detected, and also it is possible to exclude the use of the toner cartridge, which has been resupplied after completion of the refilling of the imitation toner, other than the genuine part. In addition, there is offered the effect that the toner cartridge which was used once can be used in another recording apparatus.

In addition, if the number N2 of times of recording or the number N2 of sheets of used recording papers is set equal to or larger than 1.5 times as large as the allowable number of times of recording or the allowable number of sheets of used recording papers, it is possible to solve the problem that the number of times of recording or the number of sheets of used recording papers until the stop of recording is reduced due to the fluctuation of a consumed amount of toner depending on the kinds of images.

Also, as another embodiment, after the number of times of recording or the number of sheets of used recording papers has become equal to N2 and then reaches N3 (the total N2+N3), the recording operation is stopped. For example, if the number of times of recording or the number of sheets of used recording papers is set to the allowable number of times of recording or the allowable number of sheets of used recording papers, and also N3 is set to half the allowable number of times of recording or the allowable number of sheets of used recording papers, there is offered the effect that it is possible to solve the problem that the number of times of recording or the number of sheets of used recording papers until the stop of recording is reduced due to the fluctuation of a consumed amount of toner depending on the kinds of images.

By the way, while in the above-mentioned system, the setting values for the number of times of recording or the number of sheets of used recording papers are N1 and N2, the number of setting values for the number of times of recording or the number of sheets of used recording papers may also be further increased. As a result, there is offered the effect that it is possible to obtain more accurately at a time point when a remaining amount of toner has become little or the toner has been completely consumed. Furthermore, there is offered the effect that it is possible to manage more finely the dishonest manipulation such as the refilling of the imitation toner.

In addition, as for the configuration of the system, there are the combination of the radio ID chips 5 and 7, the combination of the radio ID chips 5 and 8, the singleness of the radio ID chip 7 or 8, the combination of the radio ID chips 7 and 8, and the like. Since with these combinations, the number of times of recording or the number of sheets of used recording papers is counted and the data thereof is stored, it is possible to obtain the minimum system configuration in which the number of times of recording or the number of sheets of used recording papers which was set can be necessarily detected, and it is possible to exclude the use of the toner cartridge, which has been resupplied after completion of the refilling of the imitation toner, other than the genuine part, which is effective in reduction of the cost.

Next, an eighth system configuration of the present toner cartridge genuine part identifying system will hereinbelow be described with reference to FIG. 1. The present system includes: the toner cartridge 3 to which the ID substrate 4 having a plurality of radio ID chips 5, 7 and 8 provided therein is attached; the radio ID chip 5 including an identification storing unit in which the ID number is stored; the radio ID chips 7 and 8 each having an identification storing unit in which the ID number is stored and a control storing unit in which a control flag used to stop the operation of reading out the ID number is stored; the toner level storing/reading unit 14 having the function of reading out the ID number and the function of outputting the code which is used to stop the operation of reading out the ID number; the ID storing/reading unit 15 having the function of reading out the ID number; the control unit 16; the ID storing unit 17; and the display unit 18. The ID number of each of the radio ID chips 5, 7 and 8 contains the family code which is common to all of the elements and the serial number which varies every element. By the way, each of the radio ID chips 7 and 8 exhibits the number of times of recording or the number of sheets of used recording papers. Then, it is assumed that when the ID numbers of both of them can be read out, the number of times of recording or the number of sheets of used recording papers is zero, when the ID number of one of them can be read out, the number of times of recording or the number of sheets of used recording papers is N1, and when the ID number of none of them can be read out, the number of times of recording or the number of sheets of used recording papers is N2.

By the way, another eighth system may be configured with reference to FIG. 21. In such a way, the two radio ID chips 5 and 7 may also be provided.

First of all, at the time when the toner cartridge 3 has been attached to the recording apparatus 1, the ID storing/reading unit 15 and the toner level storing/reading unit 14 read out the ID numbers S and Y or Z which are respectively stored in the radio ID chips 5 and 7 or 8. Then, the ID numbers S and Y or Z which have been read out are outputted to the control unit 16. The operation thereof will hereinbelow be described.

(1) The Operation in New Use

When the ID numbers S, Y and Z of the attached toner cartridge 3 can be read out, and the family number of each of the ID numbers S, Y and Z matches the family code stored in the ID storing unit 17, and also as a result of comparing the ID number S with the ID number stored in the ID storing unit 17, the mismatch between them is obtained, the control unit 16 stores the ID number S in the ID storing unit 17 to start the recording operation of the recording apparatus 1. Then, the number of times of recording or the number of sheets of used recording papers is counted with as an initial value the number of times of recording or the number of sheets of used recording papers with respect to the read-out ID number Y and Z and the data thereof is stored in the ID storing unit 17 in correspondence to the ID number S. Then, if the number of times of recording or the number of sheets of used recording papers has exceeded the setting value N1 or N2, then the code which is used to stop the operation of reading out the ID number is outputted to the radio ID chips 7 or 8 for the purpose of preventing the ID number Y or Z from being able to be read out by the toner level storing/reading unit 14 to store the stop flag in the control storing unit. By the way, if the number of times of recording or the number of sheets of used recording papers has become equal to N2, then the recording operation is stopped to display on the display unit 18 the warning that the toner cartridge other than the genuine part is prohibited from being used and the warning that it has become the time to exchange the toner cartridge.

(2) The Operation When the Toner Cartridge Used Once Was Used in the Same Apparatus On the other hand, when the ID numbers S and Y or Z of the toner cartridge 3 can be read out, and the family code of each of the ID numbers S and Y or Z matches the family code stored in the ID storing unit 17, and also as a result of comparing the ID number S with the ID number registered in the ID storing unit 17, the match between them can be obtained, the recording operation of the recording apparatus 1 is started. Then, the number of times of recording or the number of sheets of used recording papers with respect to the read-out ID number Y and Z is compared with the number of times of recording or the number of sheets of used recording papers the data of which is stored in correspondence to the ID number S in the ID storing unit 17, and the number of times of recording or the number of sheets of used recording papers is counted with larger one as an initial value and the data thereof is stored in the ID storing unit 17 in correspondence to the ID number S. Then, if the number of times of recording or the number of sheets of used recording papers has exceeded the setting value N1 or N2, then the code which is used to stop the operation of reading out the ID number is outputted to the radio ID chips 7 or 8 for the purpose of preventing the ID number Y or Z from being able to be read out by the toner level storing/reading unit 14 to store the stop flag in the control storing unit. By the way, if the number of times of recording or the number of sheets of used recording papers has become equal to N2, then the recording operation is stopped to display on the display unit 18 the warning that the toner cartridge other than the genuine part is prohibited from being used and the warning that it has become the time to exchange the toner cartridge.

On the other hand, when as a result of comparing the family code of each of the ID numbers S, Y and Z of the toner cartridge 3 with the family code of the ID number registered in the ID storing unit 17, the mismatch between them is obtained, when the ID number S can not be read out and when the ID number Y or Z can not be read out, it is judged that the toner cartridge of interest is the toner cartridge other than the genuine part, and then the recording apparatus 1 stops its recording operation to display on the display unit 18 the warning that the toner cartridge other than the genuine part is prohibited from being used.

By the way, the ID numbers of the radio ID chips of the above-mentioned system may also be formed with the serial numbers which differ from one to another every element. In this case, the above-mentioned system is configured in such a way that the judgement for the family code is omitted.

In addition, it is suitable for the radio ID chip of the above-mentioned system to use the radio ID chip in which the ID number is stored in a ROM.

According to the present invention, there is offered the effect that after the toner cartridge 3 has been used until a remaining amount of toner has become little or the toner has been completely consumed, the toner can be refilled and the ID substrate 4 can be exchanged by the toner cartridge manufacturing/reclaiming unit 20 to resupply the resultant toner cartridge to the market through the reclamation/supply route 22.

In addition, since the data of the number of times of recording or the number of sheets of used recording papers is stored in the radio ID chips 7 and 8, there is offered the effect that the number of times of recording or the number of sheets of used recording papers can be necessarily detected and it is possible to exclude the use of the toner cartridge, which has been resupplied after completion of the refilling of the imitation toner, other than the genuine part. Also, there is offered the effect that the toner cartridge which was used once can be used in any of other recording apparatuses.

In addition, if the number N2 of times of recording or the number N2 of sheets of used recording papers is set equal to or larger than 1.5 times as large as the allowable number of times of recording or the allowable number of sheets of used recording papers, it is possible to solve the problem that the number of times of recording or the number of sheets of used recording papers until the stop of recording is reduced due to the fluctuation of a consumed amount of toner depending on the kinds of images.

In addition, as another embodiment, after the number of times of recording or the number of sheets of used recording papers has become equal to N2, and then reaches N3 (the total N2+N3), the recording is stopped. For example, if the number N2 of times of recording or the number N2 of sheets of used recording papers is set to the allowable number of times of recording or the allowable number of sheets of used recording papers, and also N3 is set half the allowable number of times of recording or the allowable number of sheets of used recording papers, then it is possible to solve the problem that the allowable number of times of recording or the allowable number of sheets of used recording papers until the stop of recording is reduced due to the fluctuation of a consumed amount of toner depending on the kinds of images. Therefore, there are offered the effect that the toner cartridge which was used once can be used in any of other recording apparatuses, and the effect that it is possible to exclude the use of the toner cartridge, which has been resupplied after completion of the refilling of the imitation toner without exchanging the ID substrate 4, other than the genuine part.

By the way, while in the above-mentioned system, the setting values for the number of times of recording or the number of sheets of used recording papers are N1 and N2, the number of setting values for the number of times of recording or the number of sheets of used recording papers can be further increased. As a result, there is offered the effect that it is possible to obtain accurately a time point when a remaining amount of toner has become little or the toner has been completely consumed. Furthermore, there is offered the effect that it is possible to manage more finely the dishonest manipulation such as the refilling of the imitation toner.

In addition, as for the configuration of the system, there are the combination of the radio ID chips 5 and 7, the combination of the radio ID chips 5 and 8, the singleness of the radio ID chip 7 or 8, the combination of the radio ID chips 7 and 8, and the like. With these combinations, since the number of times of recording or the number of sheets of used recording papers is counted and the data thereof is stored, the minimum system configuration is obtained in which the number of times of recording or the number of sheets of used recording papers which was set can be necessarily detected, and it is possible to exclude the use of the toner cartridge, which has been resupplied after completion of the refilling of the imitation toner, other than the genuine part, which is effective in reduction of the cost.

Next, a ninth system configuration of the present toner cartridge genuine part identifying system will hereinbelow be described with reference to FIG. 1. The present system includes: the toner cartridge 3 to which the ID substrate 4 having the radio ID chip 5 provided therein and the toner level sensors 11 and 12 are attached; the radio ID chip 5 including an identification storing unit in which the ID number is stored and a hysteresis storing unit in which the hysteresis data is stored; the toner level detecting unit 13; the ID storing/reading unit 15 having the function of reading out the ID number and the hysteresis data and the function of writing the hysteresis data; the control unit 16; the ID storing unit 17; and the display unit 18. In addition, the ID number contains the family code which is common to all of the elements and the serial number which varies every element. The toner level detecting unit 13 outputs the toner level data L0 when the toner level is equal to or higher than the output level of the toner sensor 11, the toner level data L1 when the toner level is between the output levels of the toner level sensors 11 and 12, and the toner level data L2 when the toner level is equal to or lower than the output level of the toner level sensor 12 to the control unit 16. In addition, the L1 code when the toner level is L1 as the hysteresis data, and the L2 code when the toner level is L2 as the hysteresis data are written to the hysteresis storing unit to be stored therein by the ID storing/reading unit 15. By the way, when the printer is shipped, the code L0 is written to the hysteresis storing unit.

By the way, another ninth system may be configured with reference to FIG. 18. In such a way, one toner level sensor 12 may also be provided.

First of all, at the time when the toner cartridge 3 has been attached to the recording apparatus 1, the ID storing/reading unit 15 reads out the ID number and the hysteresis data which are stored in the radio ID chip 5. The ID number S and the hysteresis data R which have been read out are outputted to the control unit 16. Then, the toner level is measured by the toner level detecting unit 13 and the data thereof is outputted to the control unit 16. The operation there of will hereinbelow be described.

When the ID number S and the hysteresis data R of the attached toner cartridge 3 can be read out, and the family code of the ID number S matches the family code registered in the ID storing unit 17, and also as a result of comparing the toner level of the read-out hysteresis data R with the measured toner level of the toner cartridge, the match between them can be obtained, the control unit 16 starts the recording operation of the recording apparatus 1. Then, if the toner level of the toner cartridge has become L1 or L2, then the L1 code or L2 code is outputted to the radio ID chip 5 by the ID storing/reading unit 15 to be stored in the hysteresis storing unit.

On the other hand, when as a result of comparing the toner level of the read-out hysteresis data R of the toner cartridge 3 with the measured toner level of the toner cartridge, the mismatch between them is obtained, it is judged that the dishonest manipulation such as the refilling of the imitation toner was carried out, and the recording operation of the recording apparatus 1 is stopped to display on the display unit 18 the warning that the toner cartridge other than the genuine part is prohibited from being used.

In addition, when as a result of comparing the family code of the ID number S of the toner cartridge 3 with the family code registered in the ID storing unit 17, the mismatch between them is obtained and when the ID number S of the toner cartridge 3 can not be read out, it is judged that the toner cartridge of interest is the toner cartridge other than the genuine part, and then the recording apparatus 1 stops its recording operation to display on the display unit 18 the warning that the toner cartridge other than the genuine part is prohibited from being used.

By the way, the ID numbers of the radio ID chips of the above-mentioned system may also be formed with the serial numbers which differ from one element to another. In this case, the above-mentioned system is configured in such a way that the judgement for the family code is omitted.

In addition, in order to prevent the data from being able to be altered dishonestly, the radio ID chip including a ROM in which the ID number is stored and an additional storage type nonvolatile memory in which the hysteresis data is stored is suitable for the radio ID chip of the above-mentioned system.

According to the present invention, there is offered the effect that after the toner cartridge 3 has been used until a remaining amount of toner has become little or the toner has been completely consumed, the toner can be refilled and the ID substrate 4 can be exchanged by the toner cartridge manufacturing/reclaiming unit 20 to resupply the resultant toner cartridge to the market through the reclamation/supply route 22.

In addition, since the data of the toner level of the consumed toner is stored in the radio ID chip 5 and the toner level is measured on the side of the recording apparatus, the change in the toner level can be detected. Therefore, there is offered the effect that it is possible to exclude the use of the toner cartridge, which has been resupplied after completion of the refilling of the imitation toner without exchanging the ID substrate 4, other than the genuine part. In addition, there is offered the effect that the toner cartridge which was used once can be used in any of other recording apparatuses.

By the way, while in the above-mentioned system, the setting values for the toner levels are L0, L1 and L2, the number of setting values therefor may be further increased. As a result, there is offered the effect that it is possible to obtain more accurately a time point when a remaining amount of toner has become little or the toner has been completely consumed. Further, there is offered the effect that it is possible to manage more finely the dishonest manipulation such as the refilling of the imitation toner.

Next, a tenth system configuration of the present toner cartridge genuine part identifying system will hereinbelow be described with reference to FIG. 1. The present system includes: the toner cartridge 3 to which the ID substrate 4 having the radio ID chip 5 provided therein and the toner level sensors 11 and 12 are attached; the radio ID chip 5 including an identification storing unit in which the ID number is stored, a hysteresis storing unit in which the hysteresis data is stored and a control storing unit in which the control flag used to select the operation of reading out the hysteresis data is stored; the toner level detecting unit 13; the ID storing/reading unit 15 having the function of reading out the ID number and the hysteresis data and the function of outputting the code which is used to select the operation of reading out the hysteresis data; the control unit 16; the ID storing unit 17; and the display unit 18. In addition, the ID number contains the family code which is common to all of the elements and the serial number which varies every element. The toner level detecting unit 13 outputs the toner level data L0 when the toner level is equal to or higher than the output level of the toner level sensor 11, the toner level data L1 when the toner level is between the output levels of the toner level sensors 11 and 12, and the toner level data L2 when the toner level is equal to or lower than the output level of the toner level sensor 12 to the control unit 16. On the other hand, if the toner level has become equal to L1 or L2, then the ID storing/reading unit 15 outputs the code which is used to select the operation of reading out the hysteresis data to store the selection flag in the control storing unit. The hysteresis storing unit, in accordance with the selection flag, outputs the L0 code in which the toner level corresponds to L0, the L1 code in which the toner level corresponds to L1, or the L2 code in which the toner level corresponds to L2. By the way, when the printer is shipped, the L0 code is already selected.

In this connection, another tenth system may be configured with reference to FIG. 18. In such a way, one toner level sensor 12 may also be provided.

First of all, at the time when the toner cartridge 3 has been attached to the recording apparatus 1, the ID storing/reading unit 15 reads out the ID number S and the hysteresis data R which are stored in the radio ID chip 5. Then, the ID number and the hysteresis data R which have been read out are outputted to the control unit 16. Then, the toner level is measured by the toner level detecting unit 13 and the data thereof is outputted to the control unit 16. The operation thereof will hereinbelow be described.

When the ID number S and the hysteresis data R of the attached toner cartridge 3 can be read out, and the family code of the ID number matches the family code registered in the ID storing unit 17, and also as a result of comparing the toner level of the read-out hysteresis data R with the measured toner level of the toner cartridge, the match between them can be obtained, the control unit 16 starts the recording operation of the recording apparatus 1. Then, if the toner level of the toner cartridge has become equal to L1 or L2, the code which is used to select the operation of reading out the hysteresis data is outputted to the radio ID chip 5 by the ID storing/reading unit 15 to store the selection flag in the control storing unit.

On the other hand, when as a result of comparing the toner level of the read-out hysteresis data R of the toner cartridge 3 with the measured toner level of the toner cartridge, the mismatch between them is obtained, it is judged that the dishonest manipulation such as the refilling of the imitation toner was carried out, and then the recording operation of the recording apparatus 1 is stopped to display on the display unit 18 the warning that the toner cartridge other than the genuine part is prohibited from being used.

In addition, when as a result of comparing the family code of the ID number S of the toner cartridge 3 with the family code registered in the ID storing unit 17, the mismatch between them is obtained and when the ID number S of the toner cartridge 3 can not be read out, it is judged that the toner cartridge of interest is the toner cartridge other than the genuine part, and the recording apparatus 1 stops its recording operation to display on the display unit 18 the warning that the toner cartridge of interest is the toner cartridge other than the genuine part.

By the way, the ID numbers of the radio ID chips of the above-mentioned system may also be formed by the serial numbers which differ from one element to another. In this case, the above-mentioned system is configured in such a way that the judgement for the family code is omitted.

In addition, for the purpose of preventing the data from being able to be altered dishonestly, the radio ID chip including a ROM in which the ID number and the hysteresis data are stored and an additional storage type nonvolatile memory in which the stop flag is stored is suitable for the radio ID chip of the above-mentioned system.

According to the present invention, there is offered the effect that after the toner cartridge 3 has been used until a remaining amount of toner has become little or the toner has been completely consumed, the toner can be refilled and the ID substrate 4 can be exchanged by the toner cartridge manufacturing/reclaiming unit 20 to resupply the resultant toner cartridge to the market through the reclamation/supply route 22.

In addition, since the data of the toner level of the consumed toner is stored in the radio ID chip 5 and also the toner level is measured on the side of the recording apparatus, the change in toner level can be detected. Therefore, there is offered the effect that it is possible to exclude the use of the toner cartridge, which has been resupplied after completion of the refilling of the imitation toner without exchanging the ID substrate 4, other than the genuine part. In addition, there is offered the effect that the toner cartridge which was used once can be used in other recording apparatuses.

By the way, while in the above-mentioned system, the setting values for the toner levels are L1, L2 and L3, the number of setting values therefor may also be further increased. As a result, there is offered the effect that it is possible to obtain more accurately a time point when a remaining amount of toner has become little or the toner has been completely consumed. In addition, there is offered the effect that it is possible to manage more finely the dishonest manipulation such as the refilling of the imitation toner.

Next, an eleventh system configuration of the present toner cartridge genuine part identifying system will hereinbelow be described with reference to FIG. 1. The present system includes: the toner cartridge 3 to which the ID substrate 4 having a plurality of radio ID chips 5, 7 and 8 provided therein and the toner level sensors 11 and 12 are attached; the radio ID chips 5, 7 and 8 each including an identification storing unit in which the ID number is stored; the toner level detecting unit 13; the toner level storing/reading unit 14 having the function of reading out the ID number and the function of breaking down electrically or mechanically in the radio ID chip for the purpose of preventing the ID number from being able to be read out; the ID storing/reading unit 15 having the function of reading out the ID number; the control unit 16; the ID storing unit 17; and the display unit 18. The ID number of each of the radio ID chips 5, 7 and 8 contains the family code which is common to all of the elements and the serial number which varies every element. The toner level detecting unit 13 outputs the toner level data L0 when the toner level is equal to or higher than the output level of the toner level sensor 11, the toner level data L1 when the toner level is between the output levels of the toner level sensors 11 and 12, and the toner level data L2 when the toner level is equal to or lower than the output level of the toner level sensor 12 to the control unit 16. By the way, each of the radio ID chips 7 and 8 exhibits the toner level. Then, it is assumed that the toner level is L0 when both of the ID numbers can be read out, the toner level is L1 when only one of the ID numbers can be read out, and the toner level is L2 when none of the ID numbers can be read out.

By the way, another eleventh system may be configured with reference to FIG. 21. The configuration may also be adopted in which only the toner level sensor 12 is provided, and also the two radio ID chips 5 and 7 are provided.

First of all, at the time when the toner cartridge 3 has been attached to the recording apparatus 1, the ID storing/reading unit 15 and the toner level storing/reading unit 14 read out the ID numbers S, Y and Z which are respectively stored in the radio ID chips 5, 7 and 8. Then, the ID numbers S, Y and Z which have been read out are outputted to the control unit 16. Then, the toner level is measured by the toner level detecting unit 13 and the data thereof is outputted to the control unit 16. The operation thereof will hereinbelow be described.

When the ID numbers S and Y or Z of the attached toner cartridge 3 can be read out and the family code of the ID number S and Y or Z matches the family code registered in the ID storing unit 17, the control unit 16 compares the toner level of the read-out hysteresis data R with the measured toner level of the toner cartridge. If the match between them can be obtained, then the recording operation of the recording apparatus 1 is started. Then, if the toner level of the toner cartridge has become equal to L1 or L2, then the radio ID chip 7 or 8 is electrically or mechanically broken down for the purpose of preventing the ID number Y or Z from being able to be read out by the toner level storing/reading unit 14.

On the other hand, when as a result of comparing the toner level of the read-out hysteresis data R of the toner cartridge 3 with the measured toner level of the toner cartridge, the mismatch between them is obtained, it is judged that the dishonest manipulation such as the refilling of the imitation toner was carried out. Then, the recording operation of the recording apparatus 1 is stopped to display on the display unit 18 the warning that the toner cartridge other than the genuine part is prohibited from being used.

In addition, when as a result of comparing the family code of each of the ID numbers S, Y and Z of the toner cartridge 3 with the family code registered in the ID storing unit 15, the mismatch between them is obtained, when the ID number S can not be read out and when the ID number Y or Z can not be read out, it is judged that the toner cartridge of interest is the toner cartridge other than the genuine part, and then the recording apparatus 1 stops the recording operation to display on the display unit 18 the warning that the toner cartridge of interest is the toner cartridge other than the genuine part.

By the way, the ID numbers of the radio ID chips of the above-mentioned system may also be formed with the serial numbers which differ from one element to another. In this case, the above-mentioned system is configured in such a way that the judgement for the family code is omitted.

In addition, it is suitable for the radio ID chip of the above-mentioned system to use the radio ID chip in which the ID number is stored in a ROM.

According to the present invention, there is offered the effect that after the toner cartridge 3 has been used until a remaining amount of toner has become little, or the toner has been completely consumed, the toner can be refilled and the ID substrate can be exchanged by the toner cartridge manufacturing/reclaiming unit 20 to resupply the resultant toner cartridge to the market through the reclamation/supply route 22.

In addition, since the toner level of the consumed toner is stored in the radio ID chip 7 or 8 and also the toner level is measured, the change in toner level can be detected. Therefore, there is offered the effect that it is possible to exclude the use of the toner cartridge, which has been resupplied after completion of the refilling of the imitation toner without exchanging the ID substrate 4, other than the genuine part. In addition, there is offered the effect that the toner cartridge which was used once can be used in any of other recording apparatuses.

By the way, while in the above-mentioned system, the setting values for the toner level are L0, L1 and L2, the number of setting values therefor may also be further increased. As a result, there is offered the effect that it is possible to obtain more accurately a time point when a remaining amount of toner has become little or the toner has been completely consumed. Further, there is offered the effect that it is possible to manage more finely the dishonest manipulation such as the refilling of the imitation toner.

In addition, as for the configuration of the system, there are the combination of the radio ID chips 5 and 7, the combination of the radio ID chips 5 and 8, the singleness of the radio ID chip 7 or 8, the combination of the radio ID chips 7 and 8, and the like. With these combinations, since the toner level can be detected by storing the consumed toner level and measuring the toner level, it is possible to exclude the use of the toner cartridge, which has been resupplied after completion of the refilling of the imitation toner, other than the genuine part, which is effective in reduction of the cost.

Next, a twelfth system configuration of the present toner cartridge genuine part identifying system will hereinbelow be described with reference to FIG. 1. The present system includes: the toner cartridge to which the ID substrate 4 having a plurality of radio ID chips 5, 7 and 8 provided therein is attached; the radio ID chip 5 including an identification storing unit in which the ID number is stored; the radio ID chip 7 and 8 including an identification storing unit in which the ID number is stored and a control storing unit in which the control flag used to stop of the operation of reading out the ID number is stored; the toner level detecting unit 13; the toner level storing/reading unit 14 having the function of reading out the ID number and the function of outputting the code which is used to stop the operation of reading out the ID number; the ID storing/reading unit 15 having the function of reading out the ID number; the control unit 16; the ID storing unit 17; and the display unit 18. The ID number of each of the radio ID chips 5, 7 and 8 contains the family code which is common to all of the elements and the serial number which varies every element. The toner level detecting unit 13 outputs the toner level data L0 when the toner level is equal to or higher than the output level of the toner level sensor 11, the toner level data L1 when the toner level is between the output levels of the toner level sensors 11 and 12, and the toner level data L2 when the toner level is equal to or lower than the output level of the toner level sensor 12 to the control unit 16. By the way, the radio ID chip 7 and 8 exhibits the toner level. Then, it is assumed that the toner level is L0 when both of the ID numbers can be read out, the toner level is L1 when only one of the ID numbers can be read out, and the toner level is L2 when none of the ID numbers can not be read out.

By the way, another twelfth system may be configured with reference to FIG. 21. The configuration may also be adopted in which only one toner level sensor 12 is provided, and also the two radio ID chips 5 and 7 are provided.

First of all, at the time when the toner cartridge 3 has been attached to the recording apparatus 1, the ID storing/reading unit 15 and the toner level storing/reading unit 14 read out the ID number S, Y and Z which are respectively stored in the radio ID chips 5, 7 and 8. Then, the ID number S, Y and Z which have been read out are outputted to the control unit 15. Then, the toner level is measured by the toner level detecting unit 13 and the date thereof is outputted to the control unit 16. The operation thereof will hereinbelow be described.

When the ID numbers S, Y and Z of the attached toner cartridge 3 can be read out and the family code of each of the ID numbers S and Y or Z matches the family code registered in the ID storing unit 17, the read-out toner level is compared with the measured toner level of the toner cartridge. If the match between them can be obtained, then the recording operation of the recording apparatus 1 is started. Then, if the toner level of the toner cartridge has become equal to L1 or L2, then the code which is used to stop the operation of reading out the ID number is outputted to the radio ID chip 7 or 8 for the purpose of preventing the ID number Y or Z from being able to be read out by the toner level storing/reading unit 14 to store the stop flag in the control storing unit.

On the other hand, when as a result of comparing the read-out toner level of the toner cartridge 3 with the measured toner level of the toner cartridge, the mismatch between them is obtained, it is judged that the dishonest manipulation such as the refilling of the imitation toner was carried out. Then, the recording operation of the recording apparatus 1 is stopped to display on the display unit 18 the warning that the toner cartridge of interest is the toner cartridge other than the genuine part.

On the other hand, when the family code of each of the ID numbers S and Y or Z of the toner cartridge 3 is compared with the family code registered in the ID storing unit 17, and as a result the mismatch between them is obtained, when the ID number S can not be read out and when the ID number Y or Z can not be read out, it is judged that the toner cartridge of interest is the toner cartridge other than the genuine part. Then, the recording apparatus 1 stops its recording operation to display on the display unit 18 the warning that the toner cartridge of interest is the toner cartridge other than the genuine part.

By the way, the ID numbers of the radio ID chips of the above-mentioned system may be formed with the serial numbers which differ from one element to another. In this case, the above-mentioned system is configured in such a way that the judgement for the family code is omitted.

In addition, it is suitable for the radio ID chip of the above-mentioned system to use the radio ID chip in which the ID number is stored in a ROM and the stop flag is stored in an additional storage type nonvolatile memory.

According to the present invention, there is offered the effect that after the toner cartridge has been used until a remaining amount of toner has become little or the toner has been completely consumed, the toner can be refilled and the ID substrate 4 can be exchange by the toner cartridge manufacturing/reclaiming unit 20 to resupply the resultant toner cartridge to the market through the reclamation/supply route 22.

In addition, since the data of the toner level of the consumed toner is stored in the radio ID chip 7 and 8 and the toner level is measured, the change in toner level can be detected. Therefore, there is offered the effect that it is possible to exclude the use of the toner cartridge, which has been resupplied after completion of the refilling of the imitation toner, other than the genuine part. In addition, there is offered the effect that the toner cartridge which was used once can be used in any of other recording apparatuses.

By the way, while in the above-mentioned system, the setting values for the toner level are L0, L1 and L2, the number of setting values for the toner level can also be further increased. As a result, there is offered the effect that it is possible to obtain more accurately a time point when a remaining amount of toner has become little or the toner has been completely consumed. Further, there is offered the effect that it is possible to manage more finely the dishonest manipulation such as the refilling of the imitation toner.

In addition, as for the configuration of the system, there are the combination of the radio ID chips 5 and 7, the combination of the radio ID chips 5 and 8, the singleness of the radio ID chip 7 or 8, the combination of the radio ID chips 7 and 8, and the like. With these combinations, since the toner level can be detected by storing the consumed toner level and measuring the toner level, it is possible to exclude the use of the toner cartridge, which has been resupplied after completion of the refilling of the imitation toner, other than the genuine part, which is effective in reduction of the cost.

Next, a thirteenth system configuration of the present toner cartridge genuine part identifying system will hereinbelow be described with reference to FIG. 1. In the present system, the system for storing the data of the toner level and the data of the number of times of recording or the number of sheets of used recording papers is configured by combining the above-mentioned fifth to eighth systems with the above-mentioned ninth to twelfth systems. The description will hereinbelow be given with respect to an embodiment which is configured by combining the fifth system with the ninth system.

The present system includes: the toner cartridge 3 to which the ID substrate 4 having the radio ID chip 5 provided therein is attached; the radio ID chip 5 including an identification storing unit in which the ID number is stored and a hysteresis storing unit in which the hysteresis data is stored; the toner level detecting unit 13: the ID storing/reading unit 15 having the function of reading out the ID number and the hysteresis data and the function of writing the hysteresis data; the control unit 16; the ID storing unit 17; and the display unit 18. In addition, the ID number contains the family code which is common to all of the elements and the serial number which varies every element. The toner level detecting unit 13 outputs the toner level data L0 when the toner level is equal to or higher than the output level of the toner level sensor 11, the toner level data L1 when the toner level is between the output levels of the toner level sensors 11 and 12, and the toner level data L2 when the toner level is equal to or lower than the output level of the toner level sensor 12 to the control unit 16. In addition, the L1 code when the toner level is L1 as the hysteresis data, and the L2 code when the toner level is L2 as the hysteresis data are written to the hysteresis storing unit to be stored therein by the ID storing/reading unit 15. By the way, when the printer is shipped, the L0 code is already written to the hysteresis storing unit. In addition, with respect to the hysteresis data, the N1 code when the number of times of recording or the number of sheets of used recording papers has exceeded N1, and the N2 code when the number of times of recording or the number of sheets of used recording papers has exceeded N2 are written to be stored by the ID storing/reading unit 15. By the way, when the printer is shipped, the N0 code exhibiting that the number of times of recording or the number of sheets of used recording papers is zero is already written.

First of all, at the time when the toner cartridge 3 has been attached to the recording apparatus 1, the ID storing/reading unit 15 reads out the ID number and the hysteresis data which are stored in the radio ID chip 5. The ID number S and the hysteresis data R which have been read out are outputted to the control unit 16. Then, the toner level is measured by the toner level detecting unit 13 and the data thereof is outputted to the control unit 16. The operation thereof will hereinbelow be described.

When the ID number S and the hysteresis data R of the attached toner cartridge 3 can be read out, and the family code of the ID number S matches the family code registered in the ID storing unit 17, and also the ID number S is not registered in the ID storing unit 17, the control unit 16 stores the ID number S in the ID storing unit 17. When the level of the read-out hysteresis data R is compared with the measured toner level of the toner cartridge, and as a result the match between them can be obtained, the recording operation of the recording apparatus 1 is started. Then, if the toner level of the toner cartridge has become equal to L1 or L2, the L1 code or the L2 code is outputted to the radio ID chip 5 by the ID storing/reading unit 15 to be stored in the hysteresis storing unit. Then, if the toner level has become equal to L2, the number of times of recording or the number of sheets of used recording papers with respect to the read-out hysteresis data R is compared with the number of times of recording or the number of sheets of used recording papers the data of which is stored in the ID storing unit 17 in correspondence to the ID number S of the ID storing unit 17, and the number of times of recording or the number of sheets of used recording papers is counted with larger one as an initial value and the data thereof is stored in the ID storing unit 17 in correspondence to the ID number S. Then, if the number of times of recording or the number of sheets of used recording papers has exceeded the setting number N1 or N2, the N1 code or the N2 code is outputted to the radio ID chip 5 by the ID storing/reading unit 15 to be stored in the hysteresis storing unit. By the way, if the number of times of recording or the number of sheets of used recording papers has become equal to N2, then the recording operation is stopped to display on the display unit 18 the warning that the toner cartridge other than the genuine part is prohibited from being used and the warning that it has become the time to exchange the toner cartridge.

On the other hand, when the toner level of the read-out hysteresis data R of the toner cartridge 3 is compared with the measured toner level of the toner cartridge, and as a result the mismatch between them is obtained, it is judged that the dishonest manipulation such as the refilling of the imitation toner was carried out. Then, the recording operation of the recording apparatus 1 is stopped to display on the display unit 18 the warning that the toner cartridge other than the genuine part is prohibited from being used.

In addition, when the family code of the ID number S of the toner cartridge 3 is compared with the family code registered in the ID storing unit 17, and as a result the mismatch between them is obtained, and when the ID number S of the toner cartridge 3 can not be read out, it is judged that the toner cartridge of interest is the toner cartridge other than the genuine part. Then, the recording apparatus 1 stops its recording operation to display on the display unit 18 the warning that the toner cartridge of interest is the toner cartridge other than the genuine part.

The above-mentioned system can be similarly applied to the various combinations of another fifth to eighth systems and ninth to twelfth systems.

As described above, according to the present invention, there are offered the effects peculiar to the above-mentioned fifth to eighth systems, and the effects peculiar to the above-mentioned ninth to twelfth systems. Also, since the number of times of recording or the number of sheets used recording papers can be counted and the data thereof can be stored with as the starting point a time point when the toner level has become equal to the setting value L2, there is offered the effect that it is possible to obtain more accurately a time point when a remaining amount of toner has become little or the toner has been completely consumed. As a result, there is offered the effect that it is possible to detect the dishonest manipulation such as the refilling the imitation toner.

Next, a fourteenth system configuration of the present toner cartridge genuine part identifying system will hereinbelow be described with reference to FIG. 1. The configuration of the present system is such that in the above-mentioned first to thirteenth systems, the ID number is registered from the IC card 23 in which the ID number of the toner cartridge is stored to the ID storing unit 17. By the way, the ID number of the toner cartridge which is previously registered in the ID managing center 21 is stored in the IC card 23. In addition, in another method, the ID storing unit 17 and the ID managing center 21 are connected to each other through the communication line 19, and the ID number of the toner cartridge registered in the ID managing center is registered therein. An embodiment in the first system will hereinbelow be described.

The present system includes: the toner cartridge 3 to which the ID substrate 4 having the radio ID chip 5 provided therein is attached; the radio ID chip 5 including an identification storing unit in which the ID number is stored and a hysteresis storing unit in which the hysteresis data is stored; the ID storing/reading unit 15 having the function of reading out the ID number and the hysteresis data and the function of writing the hysteresis data; the control unit 16; the ID storing unit 17; the display unit 18; the communication line 19; the ID managing center 21; and the ID card 23. In addition, the ID number contains the family code which is common to all of the elements and the serial number which varies every element. In addition, the hysteresis data contains a new code which is common to all of the elements and a used code.

First of all, at the time when the toner cartridge 3 has been attached to the recording apparatus 1, the ID storing/reading unit 15 reads out the ID number S and the hysteresis data R which are stored in the radio ID chip 5. Then, the ID number S and the hysteresis data R which have been read out are outputted to the control unit 16. The operation thereof will hereinbelow be described.

(1) The Operation in New Use

As to the control unit 16, when the ID number S and the hysteresis data R of the attached toner cartridge can be read out, and the ID number S matches the ID number registered in the ID storing unit 17, and the hysteresis data R is compared with the hysteresis data registered in the ID storing unit 17 so that the code of interest is judged to be the new code, the attachment flag is stored in correspondence to the ID number S of the ID storing unit 17, and the information that the attached toner cartridge 3 was used once is stored. In addition, the used code is stored in the hysteresis storing unit of the radio ID chip 5 by the ID storing/reading unit 15. As a result, the information that the attached toner cartridge 3 was used once is stored. Then, the recording apparatus 1 starts its starting operation.

(2) The Operation When the Toner Cartridge Used Once Was Used in Another Apparatus On the other hand, when the ID number S and the hysteresis data R of the toner cartridge 3 can be read out, and the ID number S matches the ID number registered in the ID storing unit 17, and the hysteresis data R is compared with the hysteresis data registered in the ID storing unit 17 so that the code of interest is judged to be the used code, since the toner cartridge of interest is the toner cartridge which was used in another printer once, the recording operation of the recording apparatus 1 is stopped to display on the display unit 18 the warning that the toner cartridge of interest is the toner cartridge other than the genuine part.

(3) The Operation When the Toner Cartridge Used Once Was Used in the Same Apparatus On the other hand, when the ID number S and the hysteresis data R of the toner cartridge 3 can be read out, and the ID number S matches the ID number registered in the ID storing unit 17, and the attachment flag is present in correspondence to the ID number S of the ID storing unit 17, and the hysteresis data R is compared with the hysteresis data registered in the ID storing unit so that the code of interest is judged to be the used code, the recording operation is started.

On the other hand, when the ID number S and the hysteresis data R of the toner cartridge 3 can not be read out, when the mismatch is obtained between the ID numbers and when the hysteresis data R is the code other than the new code and the used code, it is judged that the toner cartridge of interest is the toner cartridge other than the genuine part. Then, the recording apparatus 1 stops its recording operation to display on the display unit 18 the warning that the toner cartridge of interest is the toner cartridge other than the genuine part.

In such a way, while in the above-mentioned first to thirteenth systems, it is judged whether or not the family code of each of the read-out ID numbers S, X, Y and Z of the radio ID chips matches the family code registered in the ID storing unit 17, in the present system, it is judged whether or not each of the read-out ID numbers S, X, Y and Z of the radio ID chips matches the ID number registered in the ID storing unit 17. The above-mentioned system can be similarly applied to the above-mentioned second to thirteenth systems.

As described above, according to the present invention, there are offered the effects peculiar to the above-mentioned first to thirteenth systems. Also, since the ID number of the toner cartridge 3 in manufacture and in refilling is registered in the ID storing unit, there is offered the effect that it is possible to use only the genuine part which has been resupplied after completion of the exchange of the ID number and the refilling of the genuine toner and also it is possible to exclude any of the toner cartridges other than the genuine part. In addition, there is offered the effect that after the toner cartridge 3 has been used until a remaining amount of toner has become little or the toner has been completely consumed, the toner can be refilled and the ID substrate 4 can be exchanges by the toner cartridge manufacturing/reclaiming unit 20 to resupply the resultant toner cartridge to the market through the reclamation/supply route 22.

Next, a fifteenth system configuration of the present toner cartridge genuine part identifying system will hereinbelow be described with reference to FIG. 1. The present system includes: the toner cartridge 3 to which the ID substrate 4 having the radio ID chip 5 provided therein is attached; the ID storing/reading unit 15; the control unit 16; the ID storing unit 17; the display unit 18; the communication line 19; and the ID managing center 21. In addition, the radio ID chip 5 is the semiconductor apparatus in which the associated ID number which varies every element was written in manufacture of this semiconductor apparatus and from which the ID number can be read out. This ID number contains the family code and the serial number. The family code is the code which is common to all of the elements. By the way, the ID number of the toner cartridge which came onto the market is registered in the ID storing unit 17.

First of all, at the time when the toner cartridge 3 has been attached to the recording apparatus 1, the ID storing/recording unit 15 reads out the ID number S stored in the radio ID chip 5. The read-out ID number S is then outputted to the control unit 16. The control unit 16 sends the ID number S and the recording apparatus number to the ID managing center 21 through the communication line 19 to carry out the comparison therefor. The operation thereof will hereinbelow be described.

(1) The Operation in New Use

When the ID number S of the attached toner cartridge 3 matches the ID number registered in the ID storing unit 17, and the recording apparatus number is absent in the ID managing center 21 in correspondence to the ID number S, the control unit 16 stores the recording apparatus number of interest in the ID managing center 21 in correspondence to the ID number S. As a result, the information that the attached toner cartridge 3 was used once. Then, the recording operation is started.

(2) The Operation When the Toner Cartridge Used Once Was Used in Another Apparatus On the other hand, when the ID number S of the toner cartridge 3 matches the ID number registered in the ID storing unit 17, but the recording apparatus number of interest does not match the recording apparatus number which is recorded in the ID managing center 21 in correspondence to the ID number S, it is judged that the toner cartridge of interest was used in another recording apparatus. Then, the recording apparatus 1 stops its recording operation to display on the display unit 18 the warning that the toner cartridge of interest is prohibited from being used.

(3) The Operation When the Toner Cartridge Used Once Was Used in the Same Apparatus On the other hand, when the ID number S of the toner cartridge 3 matches the ID number registered in the ID storing unit 17 and also the recording apparatus number of interest matches the recording apparatus number which is recorded in the ID managing center in correspondence to the ID number S, the recording operation is started.

On the other hand, when the ID number S of the toner cartridge 3 does not match the ID number registered in the ID storing unit 17, and the ID number S of the toner cartridge 3 can not be read out, it is judged that the toner cartridge of interest is the toner cartridge other than the genuine part. Then, the recording operation of the recording apparatus is stopped to display on the display unit 18 the warning that the toner cartridge of interest is the toner cartridge other than the genuine part.

By the way, while in the above-mentioned system, the recording apparatus number is employed, alternatively, the use flag may also be employed instead of the recording apparatus number.

As described above, according to the present invention, since ID number and the used recording apparatus number are both registered in the ID managing center, there is offered the effect that it is possible to exclude the use of the toner cartridge other than the genuine part which has been resupplied after completion of the exchange of the ID number and the refilling of the genuine toner. In addition, there is offered the effect that after the toner cartridge 3 has been used until a remaining amount of toner has become little or the toner has been completely consumed, the toner can be refilled and the ID substrate 4 can be exchanged by the toner cartridge manufacturing/reclaiming unit 20 to resupply the resultant toner cartridge to the market through the reclamation/supply route 22.

Next, a sixteenth system configuration of the present toner cartridge genuine part identifying system will hereinbelow be described with reference to FIG. 1. The configuration of the present system is the same as that of the above-mentioned fifteenth system. The operation thereof will hereinbelow be described.

(1) The Operation in New Use

When the ID number S of the attached toner cartridge 3 matches the ID number registered in the ID storing unit 17, and the attachment flag is absent in the ID storing unit 17 in correspondence to the ID number S, and also the recording apparatus number is absent in the ID managing center 21 in correspondence to the ID number S, the control unit 16 records the recording apparatus number of interest in the ID managing center 21 in correspondence to the ID number S. In addition, the attachment flag is stored in the ID storing unit 17 in correspondence to the ID number S in the ID storing unit 17. As a result, the information that the attached toner cartridge 3 was used once is stored. Then, the recording operation is started.

(2) The Operation When the Toner Cartridge Used Once Was Used in Another Apparatus On the other hand, when the ID number S of the toner cartridge 3 matches the ID number registered in the ID storing unit 17, and the attachment flag is absent in the ID storing unit 17 in correspondence to the ID number S, and also the recording machine number of interest does not match the recording apparatus number recorded in the ID managing center in correspondence to the ID number S, it is judged that the toner cartridge of interest is the toner cartridge which was used in another recording apparatus. Then, the recording apparatus 1 stops its recording operation to display on the display unit 18 the warning that the toner cartridge of interest is prohibited from being used.

(3) The Operation When the Toner Cartridge Used Once Was Used in the Same Apparatus On the other hand, when the ID number S of the toner cartridge 3 matches the ID number registered in the ID storing unit 17, AND the attachment flag is present in the ID storing unit 17 in correspondence to the ID number S, the recording operation is started.

On the other hand, when the ID number S of the toner cartridge 3 does not match the ID number registered in the ID storing unit 17 and the ID number S of the toner cartridge 3 can not be read out, it is judged that the toner cartridge of interest is the toner cartridge other than the genuine part. Then, the recording apparatus 1 stops its recording operation to display on the display unit 18 the warning that the toner cartridge of interest is the toner cartridge other than the genuine part.

By the way, while in the above-mentioned system, the recording apparatus number is employed, alternatively, the use flag may also be employed instead of the recording apparatus number.

As described above, according to the present invention, since the ID number and the used recording apparatus number are both registered in the ID managing center, there is offered the effect that it is possible to exclude the use of the toner cartridge, which has been resupplied after completion of the exchange of the ID number and the refilling of the imitation toner, other than the genuine part.

In addition, since the attachment flag is stored in the ID storing unit, there is offered the effect that when the toner cartridge is used in the same apparatus, an access to the ID managing center can be disabled and the running cost can be reduced. In addition, there is offered the effect that after the toner cartridge 3 has been used until a remaining amount of toner has become little or the toner has been completely consumed, the toner can be refilled and the ID substrate 4 can be exchanged by the toner cartridge manufacturing/reclaiming unit 20 to resupply the resultant toner cartridge to the market through the reclamation/supply route 22.

Next, a seventeenth system configuration of the present toner cartridge genuine part identifying system will hereinbelow be described with reference to FIG. 1. The present system includes: the toner cartridge 3 to which the ID substrate 4 having the radio ID chip 5 provided therein is attached; the ID storing/reading part 15; the control unit 16; the ID storing unit 17; the display unit 18; the communication line 19; and the ID managing center 21. In addition, the radio ID chip 5 is the semiconductor apparatus to which the associated ID number which varies every element is written when manufacturing this semiconductor apparatus and from which the ID number can be read out. The ID number contains the family code and the serial number. Then, the family code is the code which is common to all of the elements. By the way, the ID number of the toner cartridge which came onto the market is recorded in the ID storing unit 17.

First of all, at the time when the toner cartridge 3 has been attached to the recording apparatus 1, the ID storing/reading unit 15 reads out the ID number S stored in the radio ID chip 5. The read-out ID number S is outputted to the control unit 16. In addition, the number of times of recording or the number of sheets of used recording papers of the toner cartridge is counted by the control unit 16. Then, the control unit 16 sends the ID number S and the data of the number of times of recording or the number of sheets of used recording papers to the ID managing center 21 through the communication line 19 to be stored therein. The operation thereof will hereinbelow be described.

When the ID number S of the attached toner cartridge 3 matches the ID number registered in the ID storing unit 17, the control unit 16 compares the number of times of recording or the number of sheets of used recording papers the data of which is stored in the ID managing center 21 in correspondence to the ID number S with the number of times of recording or the number of sheets of used recording papers the data of which is stored in the ID storing unit 17 in correspondence to the ID number S, and then the storage is carried out for the number of times of recording or the number of sheets of used recording papers of each of the ID managing center 21 and the ID storing unit 17 with larger one as an initial value. Then, the recording operation is started. Then, the number of times of recording or the number of sheets of used recording papers is counted and the data thereof is stored in the ID storing unit 17 in correspondence to the ID number S. Then, if the number of times of recording or the number of sheets of used recording papers has become equal to the setting value N1 or N2, the data of the number of times of recording or the number of sheets of used recording papers is stored in the ID managing center 21 in correspondence to the ID number S. In addition, if the number of times of recording or the number of sheets of used recording papers has become equal to the setting value N2, then the recording operation of the recording apparatus 1 is stopped to display on the display unit 18 them warning that the toner cartridge other than the genuine part is prohibited from being used.

In addition, when the ID number S of the toner cartridge 3 does not match the ID number registered in the storing unit 17 and also the ID number S of the toner cartridge 3 can not be read out, it is judged that the toner cartridge of interest is the toner cartridge other than the genuine part, and then the recording apparatus 1 stops its recording operation to display on the display unit 18 the warning that the toner cartridge of interest is the toner cartridge other than the genuine part.

As described above, according to the present invention, since the ID number and the data of the number of times of recording or the number of sheets of used recording papers are both registered in the ID managing center, there is offered the effect that it is possible to exclude the use of the toner cartridge, which has been resupplied after completion of the exchange of the ID number and the refilling of the imitation toner, other than the genuine part. In addition, there is offered the effect that after the toner cartridge 3 has been used until a remaining amount of toner or the toner has been completely consumed, the toner can be refilled and the ID substrate can be exchanged by the toner cartridge manufacturing/reclaiming unit 20 to resupply the resultant toner cartridge to the market through the reclamation/supply toner 22.

Next, an eighteenth system configuration of the present toner cartridge genuine part identifying system will hereinbelow be described with reference to FIG. 1. The present system includes: the toner cartridge 3 to which the ID substrate 4 having the radio ID chips 5 provided therein and the toner level sensors 11 and 12 are attached; the radio ID chip 5 including an identification storing unit in which the ID number is stored; the toner level detecting unit 13; the ID storing/reading unit 15 having the function of reading out the ID number; the control unit 16; the ID storing unit 17; the display unit 18; the communication line 19; and the ID managing center 21. The ID number of the radio ID chip 5 contains the family code which is common to all of the elements and the serial number which varies every element. The toner level detecting unit 13 outputs the toner level data L0 when the toner level is equal to or higher than the output level of the toner level sensor 11, the toner level data L1 when the toner level between the output levels of the toner level sensors 11 and 12, and the toner level data L2 when the toner level is equal to or lower than the output level of the toner level sensor 12 to the control unit 16. By the way, the ID number of the toner cartridge which came onto the market is registered in the ID storing unit 17.

First of all, at the time when the toner cartridge 3 has been attached to the recording apparatus 1, the ID storing/reading unit 15 reads out the ID number stored in the radio ID chip 5. The read-out ID number S is then outputted to the control unit 16. Then, the toner level is measured by the toner level detecting unit 13 and the data thereof is outputted to the control unit 16. The control unit 16 sends the ID number S and the data of the toner level to the ID managing center 21 through the communication level 19 to be stored therein. The operation thereof will hereinbelow be described.

When the ID number S of the attached toner cartridge 3 matches the ID number registered in the ID storing unit 17 and also the toner level the data of which is stored in the ID managing center 21 in correspondence to the ID number S matches the measured toner level, the control unit 16 starts the recording operation of the recording apparatus 1. Then, if the toner level of the toner cartridge has become equal to the setting value L1 or L2, then the data of the toner level is stored in the ID managing center 21 in correspondence to the ID number S. In addition, if the toner level has become equal to the setting value L2, then the recording operation of the recording apparatus 1 is stopped to display on the display unit 18 the warning that it has become the time to exchange the toner cartridge.

On the other hand, when the toner level the data of which is stored in the ID managing center 21 in correspondence to the ID number S does not match the measured toner level, it is judged that the dishonest manipulation such as the refilling of the imitation toner was carried out. Then, the recording operation of the recording apparatus 1 is stopped to display on the display unit 18 the warning that the toner cartridge of interest is the toner cartridge other than the genuine part.

On the other hand, when the ID number S of the toner cartridge 3 does not match the ID number registered in the ID storing unit 17 and when the ID number S of the toner cartridge 3 can not be read out, it is judged that the toner cartridge of interest is the toner cartridge other than the genuine part and then the recording apparatus 1 stops its recording operation to display on the display unit 18 the warning that the toner cartridge of interest is the toner cartridge other than the genuine part.

As described above, according to the present invention, since the ID number and the data of the used toner level are both registered in the ID managing center, there is offered the effect that it is possible to exclude the use of the toner cartridge, which has been resupplied after completion of the exchange of the ID number and the refilling of the imitation toner, other than the genuine part. In addition, there is offered the effect that after the toner cartridge has been used until a remaining amount of toner has become little or the toner has been completely consumed, the toner can be refilled and the ID substrate 4 can be exchanged by the toner cartridge manufacturing/reclaiming unit 20 to resupply the resultant toner cartridge to the market through the reclamation/supply route 22.

In addition, similarly to the above-mentioned thirteenth system, it is possible to configure the system in which the seventeenth system and the eighteenth system are combined with each other and which is adapted to store the data of the toner level and the data of the number of times of recording or the number of sheets of used recording papers. In this system, there are offered the effect peculiar to the eighteenth system as well as the effect peculiar to the seventeenth system. In addition thereto, since the number of times of recording or the number of sheets of used recording papers can be counted and the data thereof can be stored with a time point when the toner level is changed as the starting point, there is offered the effect that it is possible to obtain more accurately a time point when a remaining amount of toner has become little or the toner has been completely consumed. As a result, there is offered the effect that it is possible to manage more finely the dishonest manipulation such as the refilling of the imitation toner.

In addition, while in the first to eighteenth systems, the match with respect to the family code of each of the ID numbers X, Y and Z is judged, alternatively, this judgement is made the judgement whether or not the reading-out can be carried out, and hence the judgement for the family code may also be omitted.

In addition, while in the fifth to eighth systems, and in the thirteenth system and the seventeenth system, the number of times of recording or the number of sheets of used recording papers is measured, alternatively, the recording time may also be measured.

In addition, while in the systems from the ninth to twelfth systems and in the thirteenth system and the eighteenth system, the toner level is measured, alternatively, the weight of the toner may also be measured.

Also, since in the systems from the fourteenth to eighteenth systems, the use situations of the recording apparatus, the number of times of recording or the number of sheets of used recording papers in the recording apparatus, the toner level and the like can be grasped by the IC card and the ID managing center, there is offered the effect that the time of the maintenance can be judged, and the failure analysis and the like can be carried out.

In addition, while in the first to eighteenth systems, the radio ID chip is employed as the data carrier for storing therein the ID number, as for other data carriers, alternatively, there can be used the nonvolatile semiconductor memories such as a ROM (read-only memory), a PROM (programmable read-only memory), an EPROM (erasable programmable read-only memory) to which the data can be written only once, an EEPROM (electrically erasable programmable read-only memory) and an FRAM (flush random access memory). In addition, while the radio ID chip is broken down, and the data of the number of times of recording or the number of sheets of used recording papers and the data of the toner level are stored, as other data carriers, there can be used a conductor, a semiconductor, a resistor, a capacitor, a fuse and the like.

By the way, in the case where the nonvolatile semiconductor memory such as a PROM or an EPROM to which the data can be written only once is employed as the radio ID chip, the data which was stored therein without breaking down the radio ID chip can be used in the judgement for the reading-out operation. As described above, when employing the PROM or the EPROM to which the data can be written only once, there is offered the effect that the data can not be altered dishonestly by the dishonest means.

Figure 4:
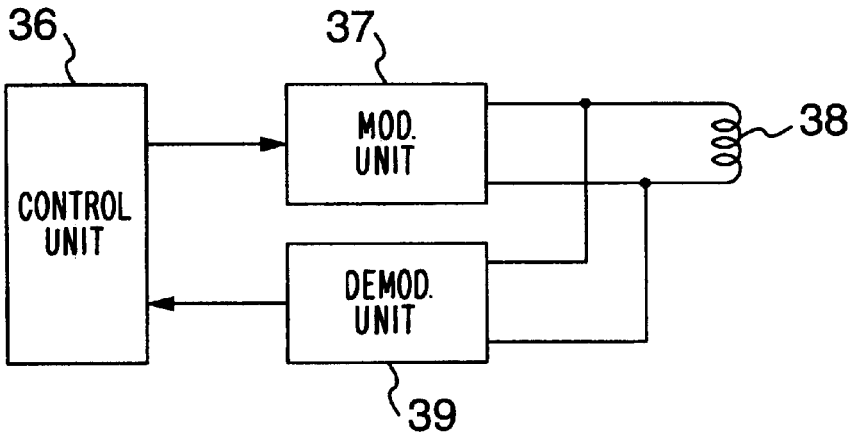
FIG. 4 is a block diagram, partly in circuit diagram, showing a circuit configuration of an embodiment of an interrogator of a radio ID chip according to the present invention.
Figure 5:
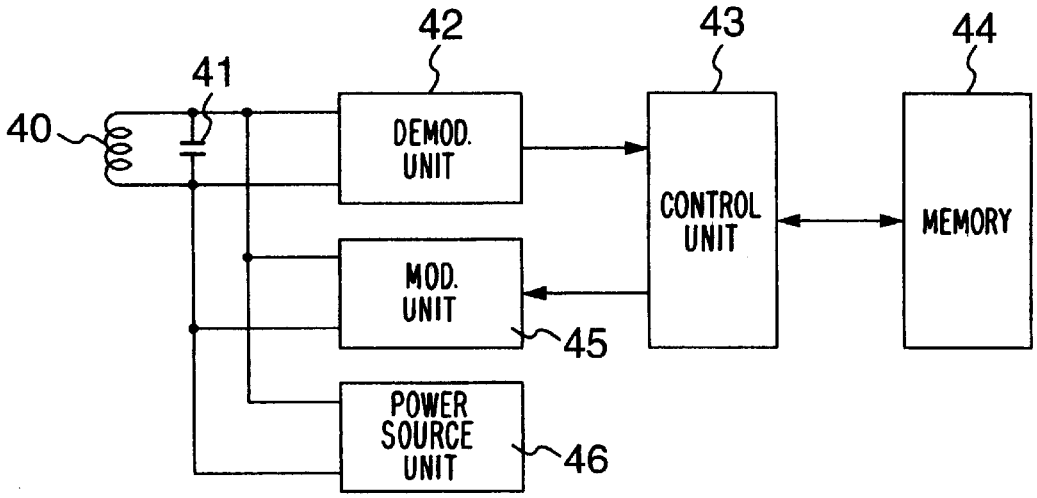
FIG. 5 is a block diagram, partly in circuit diagram, showing a circuit configuration of an embodiment of a radio ID chip according to the present invention.

In addition, as for the means for breaking down the above-mentioned radio ID chip or the nonvolatile semiconductor memory, in the case of the radio ID chip, the powerful electromagnetic wave is radiated from a coil 38 of an interrogation shown in FIG. 4 to generate the high voltage in a coil 40 of the radio ID chip shown in FIG. 5 in such a way as to become larger than the breakdown voltage of each of a capacitor 41 and the semiconductor apparatus used in the circuit, thereby breaking down electrically the radio ID chip. In addition, in the case of the nonvolatile semiconductor memory, the high voltage is applied to the power source circuit thereof in such a way as to become larger than the breakdown voltage thereof, thereby breaking down electrically the nonvolatile semiconductor memory. Also, in the case of each of the conductor, the resistor and the fuse, a large current is caused to flow therethrough to disconnect the circuit wiring. In addition thereto, as for the mechanical breaking down means, the data carrier is struck from the outside to be damaged.

Figure 2:
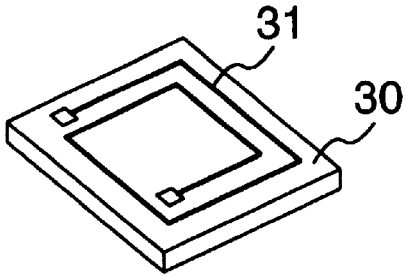
FIG. 2 is a perspective view showing structure of an embodiment of a radio ID chip according to the present invention.

Next, the description will hereinbelow be given with respect to the radio ID chip used in each of the above-mentioned systems. FIG. 2 is a perspective view showing the external appearance of an embodiment of the radio ID chip. The radio ID chip is constituted by an integrated circuit 30 which is formed on a silicon substrate, and an on-chip antenna 31 which is formed in an insulation manner on the integrated circuit 30. The outside dimension thereof is equal to or smaller than 3 mm×3 mm and the thickness thereof is equal to or smaller than 0.5 mm. By the way, the radio ID chip having the outside dimension equal to or smaller than 0.5 mm×0.5 mm is suitable in terms of the cost. The electric power and the signal are received through the electromagnetic coupling by the on-chip antenna 31 to output the ID number stored in a memory of the integrated circuit 30 through the on-chip antenna.

Figure 3:
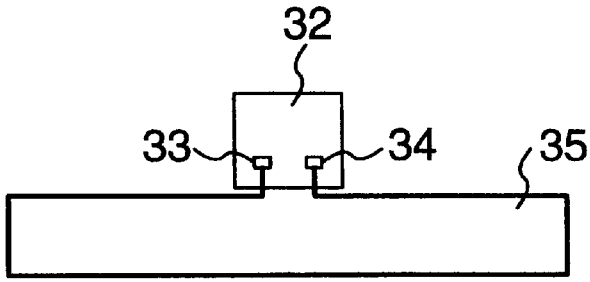
FIG. 3 is a schematic view showing structure of another embodiment of a radio ID chip according to the present invention.

FIG. 3 shows another embodiment of the radio ID chip. The radio ID chip includes: an integrated circuit 32 which is formed on a silicon substrate; antenna terminals 33 and 34 of the integrated circuit 30; and an external antenna 35 connected to the antenna terminals 33 and 34. The electric power and the signal are received through the electromagnetic coupling by the external antenna 35 to output the ID number stored in a memory of the integrated circuit 32 through the external antenna. Since the large external antenna 35 can be formed, the distance for the transmission/reception of the signal can be increased.

FIG. 4 shows an embodiment of a circuit configuration of an interrogator. The interrogator carries out the supply of the electric power to the radio ID chip and the transmission/reception of the signal through the electromagnetic coupling. The interrogator includes a control unit 36, a modulation unit 37, an antenna 38, and a demodulation unit 39. A radio ID chip control signal and the hysteresis data are sent from the control unit 36 to the modulation unit 37 to be modulated with the carrier frequency in the modulation unit 37 to be outputted in the form of the electromagnetic wave through the antenna 38. In addition, the ID number and the hysteresis data which have been modulated with the carrier frequency from the radio ID chip are received at the antenna 38 to be demodulated in the demodulation unit 39 to be outputted to the control unit 36.

FIG. 5 shows an embodiment of a circuit configuration of the radio ID chip. The radio ID chip includes an antenna 40, a tuning capacitor 41, a demodulation unit 42, a control unit 43, a memory 44, a modulation unit 45, and a power source unit 46. The signal having the carrier frequency is received at the antenna 40 and the tuning capacitor 41. The power source for operating this circuit is generated from the carrier frequency in the power source unit 46. The signal having the carrier frequency is demodulated by the demodulation unit 42 to output the radio ID chip control signal and the hysteresis data to the output unit 43. The control unit 43 reads out the ID number and the hysteresis data which are stored in the memory 44 to output the ID number and the hysteresis data thus read out to the modulation unit 45. In addition, the control unit 43 stores the hysteresis data in the memory 44. The modulation unit 45 operates in such a way as to modulate the ID number and the hysteresis data with the carrier frequency to output the resultant signal in the form of the electromagnetic wave through the antenna 40.

In addition, the control unit 43 is provided with the function of storing the radio ID chip control signal and the function of stopping the reading-out operation in accordance with the radio ID chip control signal and selecting the data among a plurality of hysteresis data to output the selected data.

By the way, there may be employed as the memory 44 a ROM type memory to which the ID number is written in the manufacture process, a PROM type memory to which the ID number is written after completion of the manufacture, a nonvolatile RAM for recording and holding therein the data, or the combination thereof. In the case of employing the ROM type memory, there is offered the effect that an inexpensive memory can be obtained in terms of the cost.

Figure 6:
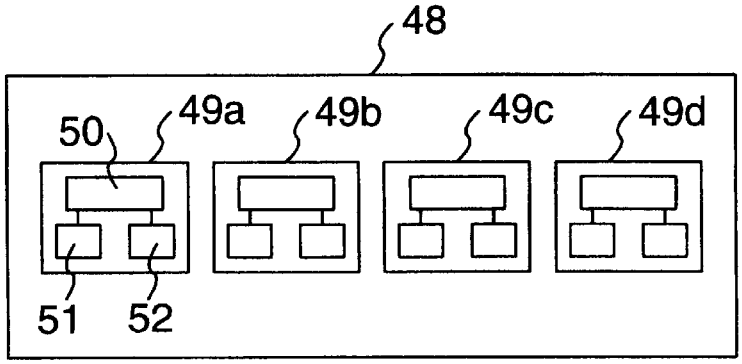
FIG. 6 is a schematic view showing structure of a data carrier employing an optical apparatus according to the present invention.

Next, another embodiment of the data carrier will hereinbelow be described. FIG. 6 shows an embodiment of the data carrier employing an optical apparatus. The present embodiment includes a substrate 48 to which a plurality of data carriers are mounted, data carriers 49, and an integrated circuit 50, an optical light receiving apparatus 51 and an optical light transmitting apparatus 52 constituting each of the data carriers 49. At the time when a transmission command signal has been received by the optical light receiving apparatus 51, the integrated circuit 50 operates in such a way as to output the ID number through the optical light transmitting apparatus 52.

According to the present invention, by only converting the digital signal into the optical signal, the data can be transmitted/received, which is effective in reduction of the cost. In addition, since the signal can be transmitted/received in a noncontact manner, there is offered the effect that it is possible to enhance the mounting efficiency.

Figure 7:
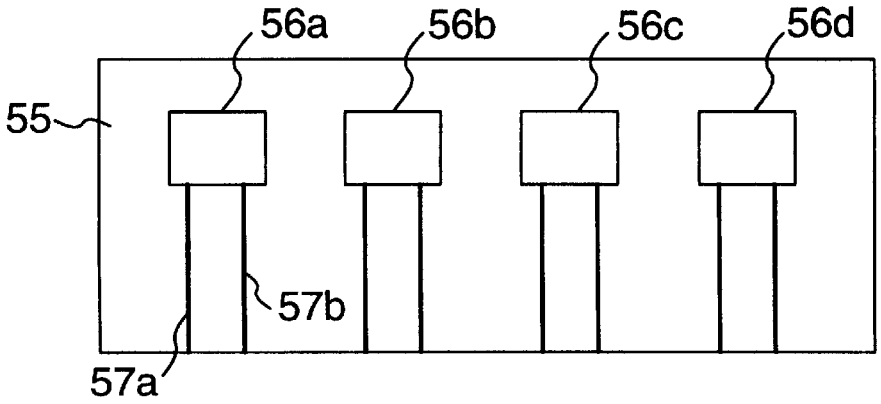
FIG. 7 is a schematic view showing structure of a data carrier employing a nonvolatile semiconductor memory according to the present invention.

FIG. 7 shows an embodiment of the data carrier employing a nonvolatile memory. The present embodiment includes a base substrate 55 to which a plurality of data carriers are mounted, nonvolatile memories 56, signal lines 57*a*, and electric power lines 57*b*. The signal line 57*a* includes a data signal line and a control signal line through which the data is read out/written. At the time when the read-out signal has been inputted through the signal line 57*a*, the nonvolatile memory 56 operates in such a way as to output the data of the ID number to the signal line 57*a*.

According to the present invention, since the signal from the nonvolatile memory is delivered through the contact part of the signal line, there is offered the effect that it is possible to reduce the cost.

Figure 8:
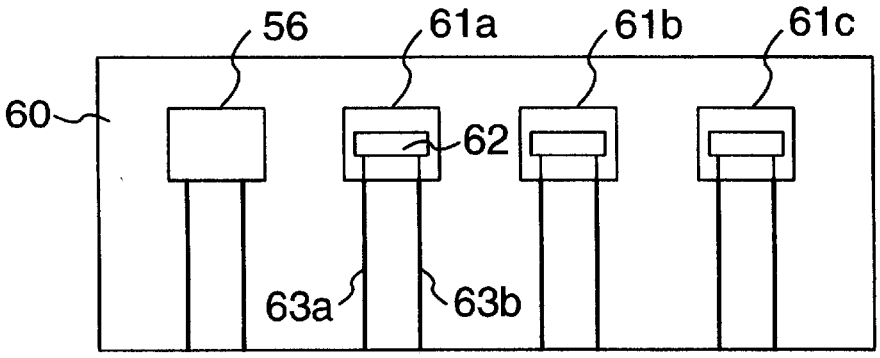
FIG. 8 is a schematic view showing structure of an embodiment of another data carrier according to the present invention.

FIG. 8 shows another embodiment of the data carrier. The present embodiment includes a base substrate 60 to which a plurality of data carriers are mounted, the nonvolatile memory 56 shown in FIG. 7, elements 61 each of which includes a conductor, a semiconductor, a resistor, a capacitor or a fuse, and signal lines 63. In the figure, reference numeral 62 designates the element. The element including the conductor, the semiconductor, the resistor or the fuse confirms both of the storage and the breakdown on the basis of the resistance value thereof. If the resistance value is the specified value, then the storage state is confirmed, while if the resistance value is infinite, then the breakdown state is confirmed. When employing the capacitor, if the current thereof changes in accordance with a certain time constant, then the storage state is confirmed, while if the resistance value thereof is either zero or infinite, then the breakdown state is confirmed.

According to the present invention, since the signal from the nonvolatile memory is delivered through the constant part of the signal line, there is offered the effect that it is possible to reduce the cost. In addition thereto, since the conductor, the semiconductor, the resistor, the capacitor or the fuse is employed as the memory, this is effective in reduction of the cost.

Figure 9:
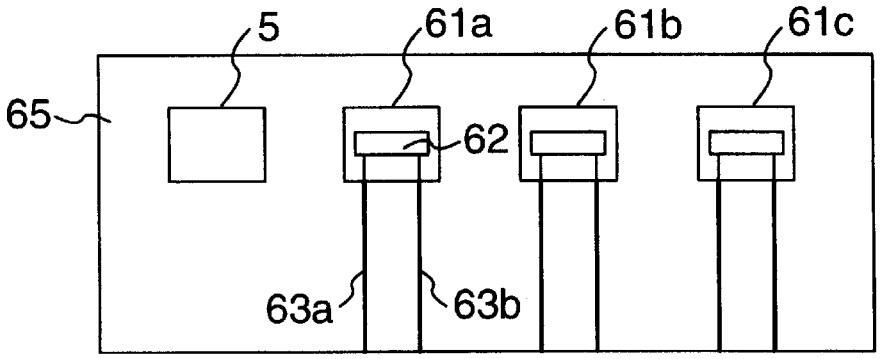
FIG. 9 is a schematic view showing structure of an embodiment of still another data carrier according to the present invention.

FIG. 9 shows still another embodiment of the data carrier. The present embodiment includes a base substrate 65 to which a plurality of data carriers are mounted, the radio ID chip 5 shown in FIG. 1, elements 61 each of which includes a conductor, a semiconductor, a resistor, a capacitor or a fuse, and signal lines 63. The element including the conductor, the semiconductor, the resistor or the fuse confirms the storage and the breakdown on the basis of the resistance value thereof. If the resistance value is the specified value, then the storage state is confirmed, while of the resistance value is infinite, then the breakdown state is confirmed. When employing the capacitor, if the current thereof changes in accordance with a certain time constant, then the storage state is confirmed, while if the resistance value thereof is either zero or infinite, then the breakdown state is confirmed.

According to the present invention, since the element including the conductor, the semiconductor, the resistor, the capacitor or the fuse is employed, there is offered the effect that it is possible to reduce the cost.

Figure 10:
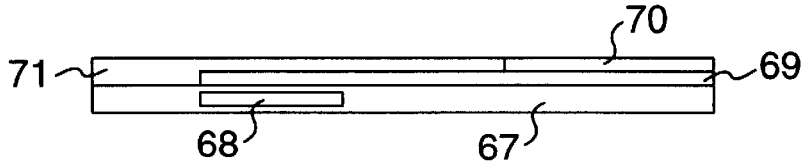
FIG. 10 is a cross sectional view showing structure of another embodiment of a radio ID chip according to the present invention.

FIG. 10 shows another embodiment of the radio ID chip. The present embodiment includes a base substrate 67 made of paper, resin such as plastic or glass epoxy, a radio ID chip 68 which is either made in or embedded in the substrate 67, an antenna 69 which is formed on the surface of the base substrate 67, a lead terminal 70 through which a signal is supplied to the antenna 69, and a covering body 71 with which the substrate 67 and the antenna 69 are covered. The radio ID chip 68 operates in such a way that the signal is supplied through the lead terminal 70 and the electromagnetic coupling is obtained through the antenna 69. The antenna 69 corresponds to the antenna 38 shown in FIG. 4. As for the radio ID chip, there is employed the radio ID chip including a thin silicon substrate the thickness of which is equal to or smaller than 0.5 mm.

According to the present invention, since the interrogator and the radio ID chip are electromagnetically tightly coupled to each other, there is no loss of the magnetic field, the efficiency is enhanced and also the radiated electric power of the interrogator can be reduced, which is effective in miniaturization as well as in low electric power. In addition, since the distance is fixed, there is offered the effect that it is possible to enhance the reliability.

Figure 11:
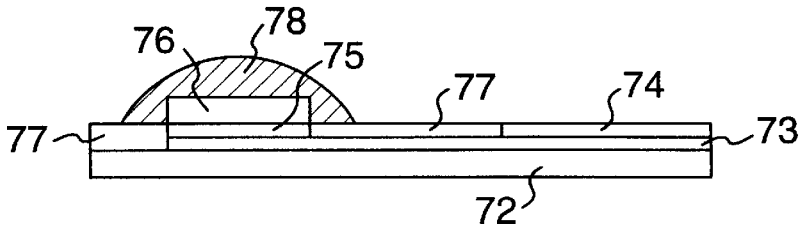
FIG. 11 is a cross sectional view showing structure of still another embodiment of a radio ID chip according to the present invention.

FIG. 11 shows still another embodiment of the radio ID chip. The present embodiment includes a base substrate 72 such as a substrate made of paper, resin such as plastic, or glass epoxy, an antenna 73 which is formed on the surface of the base substrate 72, a lead terminal 74 through which a signal is supplied to the antenna 73, a covering body 77 with which the base substrate 72 and the antenna 73 are covered, the radio ID chip which is adhered to the surface of the antenna 73 by adhesive 75, and resin 78 with which the radio ID chip 76 is covered. The signal is supplied through the lead terminal 74 and the electromagnetic coupling is obtained through the antenna 73 to operate the radio ID chip 78. The antenna 73 corresponds to the antenna 38 shown in FIG. 4.

According to the present invention, since the interrogator and the radio ID chip are electromagnetically tightly coupled to each other, there is no loss of the magnetic field, the efficiency is enhanced and also the radiated electric power of the interrogator can be reduced, which is effective in miniaturization as well as in low electric power. In addition, since the distance is fixed, there is offered the effect that is possible to enhance the reliability. Also, there is offered the effect that it is possible to use the radio ID chip having the relatively large chip size.

Figure 12:
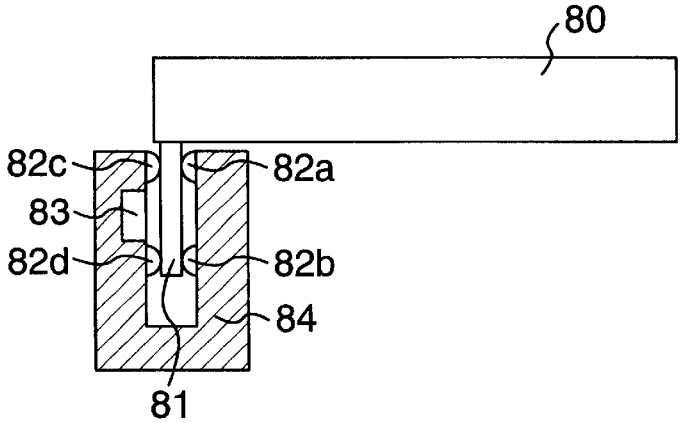
FIG. 12 is a cross sectional view showing construction of a unit for delivering data between a noncontact type data carrier and an interrogator according to the present invention.

FIG. 12 shows an embodiment of construction of a part of delivering the data between a noncontact type data carrier and an interrogator. The present embodiment includes a toner cartridge 80, a base substrate 81 which is attached to the toner cartridge 80 and to which the data carrier is mounted, insertion guides 82 which are attached to the recording apparatus side, an interrogator 83, and an insertion part supplying body 84. The base substrate 81 is inserted along the insertion guides 82, and the data carrier is adapted to be positioned in the position of the interrogator 83.

According to the present invention, since the base substrate can be positioned by the insertion guides, there is offered the effect that the distance between the base substrate and the interrogator can be fixed and also it is possible to enhance the reliability of reading out/writing the data.

Figure 13:
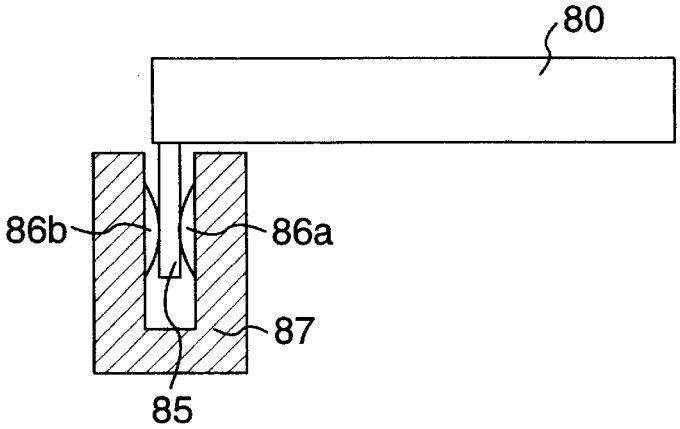
FIG. 13 is a cross sectional view showing construction of a unit for delivering data between a contact type data carrier and an interrogator according to the present invention.

FIG. 13 shows an embodiment of construction of a data delivering part of a contact type data carrier. The present embodiment includes a toner cartridge 80, a base substrate 85 which is attached to the toner cartridge 80 and to which the data carrier is mounted, contact springs 86 which are mounted to the recording apparatus side and which come in contact with the signal line and the electric power line of the data carrier, and an insertion part supplying body 87. The base substrate 85 is inserted along the contact springs 86, and the data is exchanged between the signal line and the electric power line of the data carrier and the contact springs 86.

According to the present invention, since the base substrate is positioned by the contact springs, there is offered the effect that the data can be read out/written through the signal line and the electric power line.

Figure 14:
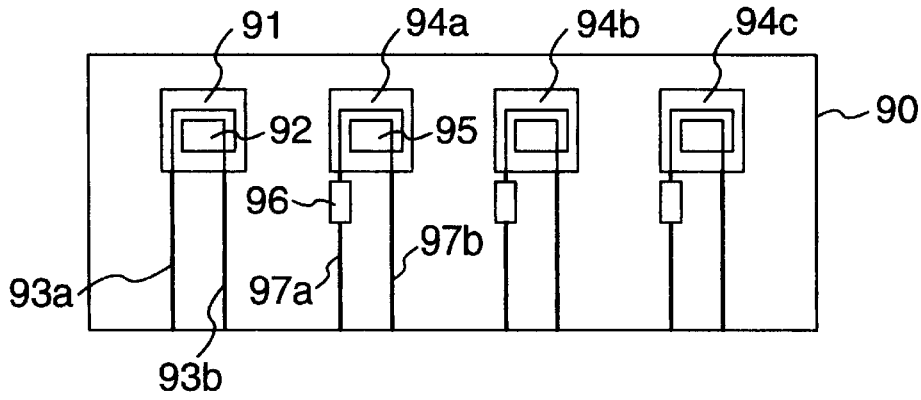
FIG. 14 is a schematic view of an embodiment in which a data carrier is electrically broken down according to the present invention.

FIG. 14 shows an embodiment of a unit for breaking down electrically the radio ID chip and the nonvolatile semiconductor memory. The present embodiment includes a base substrate 90 to which the data carriers are attached, data carriers 91 and 94 of the radio ID chip and the nonvolatile semiconductor memory, elements 93 and 97 exhibiting an antenna of the radio ID chip, and signal lines and electric power lines of the nonvolatile semiconductor memory, and an electronic component 96, such as a conductor, a resistor or a fuse, which is provided in the middle of the circuit of the signal lines and the electric power lines. For the purpose of preventing the data from being able to be read out/written from/to these data carriers, the large current is caused to flow through the electronic component 96 to disconnect the electronic component 96.

As described above, according to the present invention, since the circuit is disconnected, the data becomes unable to be read out/written the data from/to these data carriers. Therefore, there is offered the effect that it is possible to store the information that the toner carrier was used once.

Figure 15:
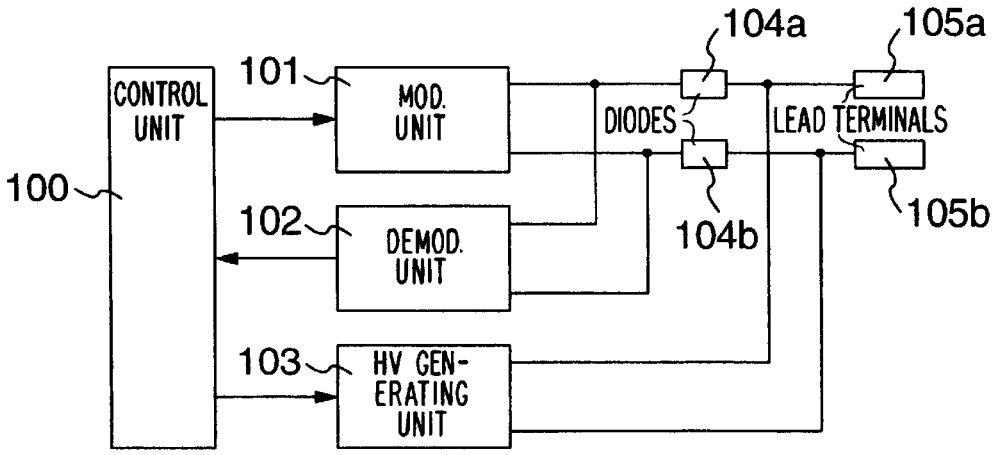
FIG. 15 is a block diagram showing a circuit configuration of an embodiment of an interrogator of a radio ID chip having a high voltage generating unit according to the present invention.

FIG. 15 shows an embodiment of an interrogator of the radio ID chip. The present embodiment shown in FIG. 15, in terms of the function, is the same as that of the interrogator shown in FIG. 4. The present embodiment includes a control unit 100, a modulation unit 101, a demodulation unit 102, a high voltage generating unit 103, diodes 104 for separating electrically the low voltage side of the modulation unit 101 and the demodulation unit 102 from the high voltage side of the high voltage generating unit 103, and lead terminals 105 which are connected to the antennas 69 and 73 shown in FIG. 10 and FIG. 11, respectively. The high voltage is generated by the high voltage generating unit 103 to break down electrically the radio ID chip shown in FIG. 10 or FIG. 11.

As described above, according to the present invention, since the radio ID chip is broken down, the data becomes unable to be read out/written. Therefore, there is offered the effect that it is possible to store the information the toner cartridge was used once.

Figure 16:
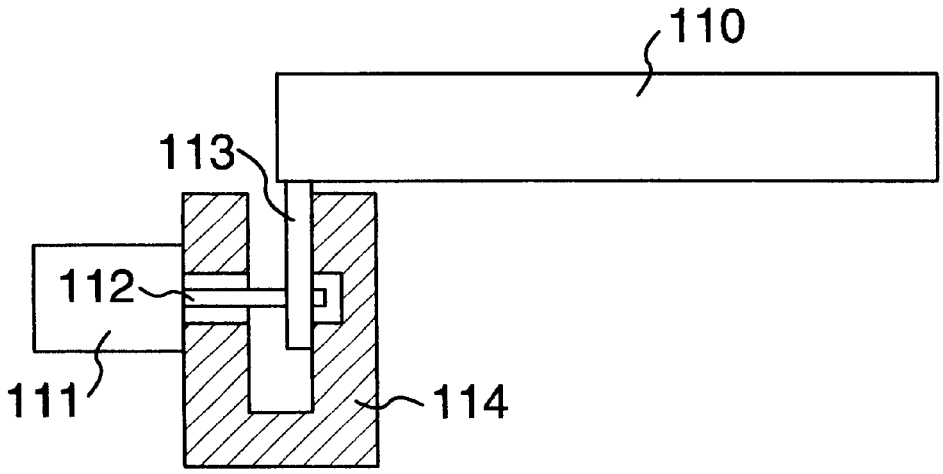
FIG. 16 is a cross sectional view showing construction of an embodiment of a punching mechanism for breaking down mechanically a data carrier according to the present invention.
Figure 17:
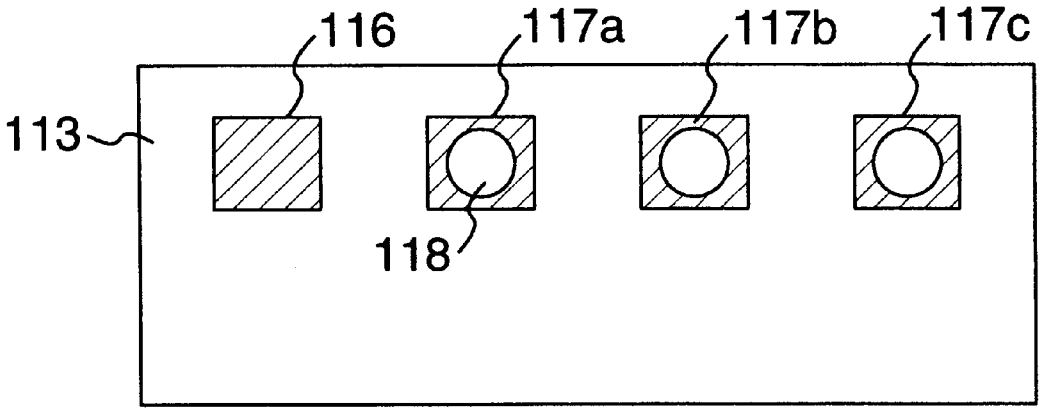
FIG. 17 is a schematic view showing an ID substrate in which data carriers were mechanically broken down according to the present invention.

FIG. 16 and FIG. 17 explain an embodiment of a punching mechanism for breaking down mechanically the data carrier. The present embodiment shown in FIG. 16 includes a toner cartridge 110, a base substrate 113 which is attached to the toner cartridge and to which the data carrier is mounted, an apparatus side supporting body 114, an electromagnetic solenoid 111 which is mounted to the supporting body 114, a punch rod 112 which is moved by the electromagnetic solenoid 111, and an antenna (not shown) of the interrogator shown in FIG. 12 which is provided on the side opposite to the electromagnetic solenoid 111 or a contact spring (not shown) of the interrogator shown in FIG. 13. FIG. 17 shows the base substrate to which the data carriers are attached. This unit include the base substrate 113, and data carriers 116 and 117. A current is caused to flow through the electromagnetic solenoid 111 to punch and break down mechanically the data carriers 117 attached to the base substrate 115 by the punch bar 112. In the figure, reference numeral 118 designates a punched hole.

As described above, according to the present invention, since the data carrier is punched to be broken down mechanically by the punching mechanism, the data becomes unable to be read out/written. Therefore, there is offered the effect that it is possible to store the information that the toner cartridge was used once.

In addition, there is offered the effect that the punching mechanism can break down the data carrier by applying the pressure to the data carrier.

Figure 22:
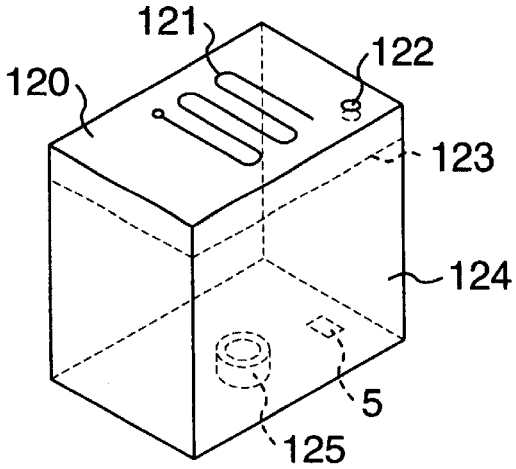
FIG. 22 is a perspective view showing construction of an embodiment in which the present invention is applied to an ink cartridge.
Figure 23:
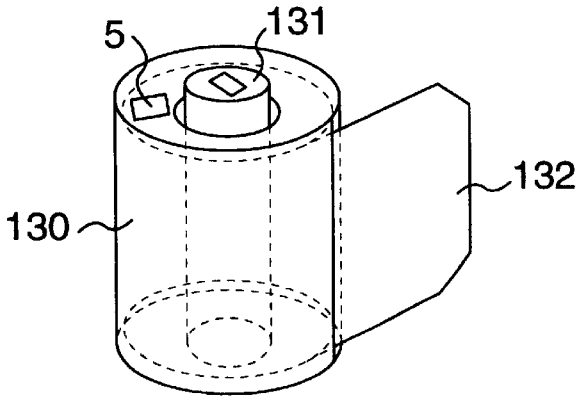
FIG. 23 is a perspective view showing construction of an embodiment in which the present invention is applied to a film of a camera.

The present invention, in addition to the toner cartridge, may also be applied to an ink cartridge of an inkjet printer shown in FIG. 22. The present part includes an ink cartridge 120, a narrow pipe-like air taking-in port 121 which is provided in the outer packing member of the ink cartridge 120 in such a way as to be free from the influence by the dust, the humidity and the like, an ink injection port 122, a sponge-like member 123 for absorbing ink 124, a connection port 125 through which the ink 124 is supplied to an ink discharge port made of a piezo element or the like, and the radio ID chip 5 which is provided in the outer packing member of the ink cartridge 120.

According to the present invention, since the information that the ink cartridge was used is stored in the radio ID chip 5, there is offered the effect that it is possible to exclude the use of the ink cartridge, which has been resupplied after completion of the refilling of the imitation ink without exchange the radio ID chip 5, other than the genuine part.

In addition, the radio ID chip may also be self-contained in a film of a camera or a film with a lens which is supplied with the camera and the film as one. The present part includes an outer packaging 130, an axis 131 round which a film 132 is wound up, and the radio ID chip 5 provided in the outer packaging 130.

According to the present invention, there is offered the effect that it is possible to exclude the use of the film, in which the ID number of the radio ID chip 5 can not be read out, other than the genuine part.

Figure 24:
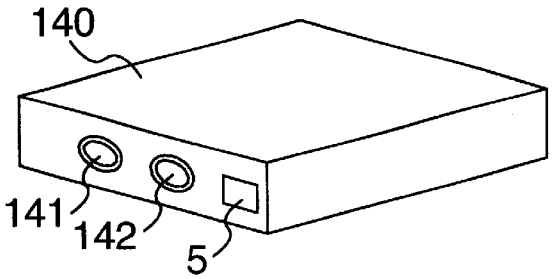
FIG. 24 is a perspective view showing construction of an embodiment in which the present invention is applied to a charging type battery.

In addition, as shown in FIG. 24, the radio ID chip 5 may also be self-contained in a charging type battery for use in a portable telephone and the like. The present part includes an outer packing 140, electrodes 141 and 142, and the radio ID chip 5 which is provided in the outer packing 140.

According to the present invention, since the information that the battery was used once is stored in the radio ID chip 5, there is offered the effect that it is possible to exclude the use of the battery in any of other portable telephones.

According to the present invention, the data carrier in which the peculiar ID number was stored is attached to the toner cartridge, and if the toner cartridge is used once, then the hysteresis data is stored in the data carrier of the toner cartridge. In addition, the nonvolatile semiconductor memory such as a PROM or an EPROM in which the data can be written only once can be used in the above-mentioned radio ID chips 6, 7 and 8. In this case, the stored data can be used in the judgement for the reading-out without breaking down the radio ID chip.

In such a way, when employing a PROM or an EPROM to which the data can be written only once, there is offered the effect that the data can not be altered dishonestly by the dishonest means. In addition, since the ID number is stored in the recording apparatus, there is offered the effect that it is possible to detect the toner cartridge in which the imitation toner was refilled and also such a toner cartridge can be made unable to be used. In addition, since the data of the number of times of use and the data of the toner level are detected as the hysteresis data to be stored in the data carrier, there is offered the effect that it is possible to detect the toner cartridge in which the imitation toner was refilled and also such a toner cartridge can be made unable to be used. In addition, the ID numbers are registered in the ID managing center in manufacture of the toner cartridges to be collectively managed, the comparison with respect to the ID numbers is carried out through the recording medium such as an IC card and the communication line, and the ID number of the used devices is stored in correspondence to the ID number registered in the ID managing center so that the toner cartridge is prevented from being able to be used in any of other apparatuses. Therefore, there is offered the effect that it is possible to detect the toner cartridge in which the imitation toner was refilled and also such a toner cartridge can be made unable to be used. Also, since the data of the number of times of use, and the data of the toner level are stored in correspondence to the ID number registered in the ID managing center, there is offered the effect that it is possible to detect the toner cartridge in which the imitation toner was refilled and also such a toner cartridge can be made unable to be used.

While the present invention has been particularly shown and described with reference to the embodiments, it will be understood that the various changes and modifications will occur to those skilled in the art without departing from the scope and true spirit of the invention. The scope of the invention is therefore to be determined solely by the appended claims.

What is claimed is:

1. A replacing part containing a consumable and including identification means for storing therein identification data, comprising:

an identification data storing unit for outputting peculiar identification data in accordance with a reading-out request made from the outside of said part; and a hysteresis holding unit for after having responded to the reading-out request, holding an initial read-out hysteresis in which the identification data is read out.

2. A replacing part according to claim 1, wherein said hysteresis holding unit includes an additional storage type memory.

3. A replacing part according to claim 1, wherein said hysteresis holding unit is another identification data storing unit and peculiar identification data is stored in said another identification data storing unit.

4. A replacing part according to claim 3, wherein after an initial reading-out request has been made from the outside to said identification data storing unit, said hysteresis holding unit becomes unable to read out the identification data of said another identification data storing unit.

5. An image forming apparatus to which a replacing part containing a consumable including identifying means for storing therein identification data is loaded, and which has a reading-out unit for reading out the identification data from said replacing part, wherein said replacing part comprises an identification data storing unit for outputting peculiar identification data in accordance with a reading-out request made from said read-out unit; and a hysteresis holding unit for after having responded to the reading-out request, holding an initial read-out hysteresis in which the identification data is read out, and wherein said image forming apparatus comprises:

a hysteresis processing unit for after the identification data has been read out from said identification data storing unit, executing the processing of holding an initial read-out hysteresis, in which the identification data is read out, for said hysteresis holding unit;

an identification data storing unit in which identification data of said replacing part is stored; and a replacing part identification processing unit for comparing the read-out identification data with the identification data stored in said identification data storing unit, and if said hysteresis holding unit does not hold the read-out hysteresis when the identification data is not stored in said identification data storing unit, storing therein the read-out identification data in said identification data storing unit to permit the use of said replacing part.

6. An image forming apparatus according to claim 5, wherein said hysteresis holding unit includes an additional storage type memory.

7. An image forming apparatus according to claim 5, wherein said hysteresis holding unit is another identification data storing unit and peculiar identification data is stored in said another identification data storing unit.

8. An image forming apparatus according to claim 7, wherein after an initial reading-out request has been made from the outside to said identification data storing unit, said hysteresis holding unit becomes unable to read out the identification data of said another identification data storing unit.

9. An image forming apparatus according to claim 5, wherein if said hysteresis holding unit holds the read-out hysteresis when the read-out identification data is stored in said identification data storing unit, then said replacing part identification processing unit permits the use of said replacing part.

10. An image forming apparatus according to claim 5, wherein if said hysteresis holding unit holds the read-out hysteresis when the read-out identification data is not stored in said identification data storing unit, then said replacing part identification processing unit does not permit the use of said replacing part.

11. An image forming apparatus to which a replacing part containing a consumable including identifying means for storing therein identification data is loaded, and which has a reading-out unit for reading out the identification data from said replacing part, wherein said replacing part includes an identification data storing unit for outputting peculiar identification data in accordance with a reading-out request made from said reading-out unit, and a hysteresis holding unit for storing data of a consumable level, and wherein said image forming apparatus comprises:

an identification data storing unit in which identification data of said replacing part is stored;

a consumable level detecting unit for measuring a consumable level; and a replacing part identification processing unit for when after the identification data and the data of the consumable level have been respectively read out from said identification data storing unit and said hysteresis holding unit, the read-out identification data matches the identification data stored in said identification data storing unit and also the read-out consumable level matches the measured consumable level, permitting the use of said replacing part to store the data of the measured consumable level in said hysteresis holding unit.

12. An image forming apparatus according to claim 11, wherein said replacing part identification processing unit does not permit the use of said replacing part when the read-out identification data does not match the identification data stored in said identification data storing unit, and when the read-out consumable level is compared with the measured consumable level and as a result the measured consumable level is increased.

13. An image forming apparatus to which a replacing part containing a consumable including identifying means for storing therein identification data is loaded, and which has a reading-out unit for reading out the identification data from said replacing part, wherein said replacing part includes an identification data storing unit for outputting peculiar identification data in accordance with a reading-out request made from said reading-out unit, and a hysteresis holding unit for storing data of the number of sheets required for the image processing, and wherein said image forming apparatus comprises:

an identification data storing unit for storing therein identification data of said replacing part; and a replacing part identification processing unit for when after the identification data and data of the number of sheets required for the image processing have been respectively read out from said identification data storing unit and said hysteresis holding unit, the read-out identification data matches the identification data stored in said identification data storing unit, permitting the use of said replacing part, counting the number of sheets required for the image processing with the read-out number of sheets required for the image processing as an initial value and storing the counted number of sheets required for the image processing in said hysteresis holding unit.

14. An image forming apparatus according to claim 13, wherein the read-out identification data does not match the identification data stored in said identification data storing unit and when the number of sheets required for the image processing becomes equal to or larger than a setting value, said replacing part identification processing unit does not permit the use of said replacing part.

15. An image forming apparatus according to claim 11, wherein said replacing part includes an identification data storing unit for outputting peculiar identification data in accordance with a reading-out request made from said reading-out unit, and a hysteresis holding unit for storing therein the data of the consumable level and the data of the number of sheets required for the image processing, and said replacing part identification processing unit counts the number of sheets required for the image processing with as an initial value the data of the number of sheets required for the image processing read out from said hysteresis holding unit from a time point when the consumable level has been equal to or lower than a setting value, stores the data of the counted number of sheets required for the image processing in said hysteresis holding unit, and when the number of sheets required for the image processing becomes equal to or larger than the setting value, does not permit the use of said replacing part.

16. An image forming apparatus according to claim 15, further comprising an identification data inputting unit for storing therein additionally the identification data in said identification data storing unit through a network from the outside of said image forming apparatus.

17. An image forming apparatus according to claim 5, further comprising an identification data inputting unit for storing therein additionally the identification data in said identification data storing unit through a portable storage medium from the outside of said image forming apparatus.

* * * * *